US009167883B2

(12) United States Patent
Demskey

(10) Patent No.: US 9,167,883 B2
(45) **Date of Patent: *Oct. 27, 2015**

(54) BACKPACK

(71) Applicant: Joan F. Demskey, New York, NY (US)

(72) Inventor: Joan F. Demskey, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/556,694

(22) Filed: Dec. 1, 2014

(65) Prior Publication Data

US 2015/0136824 A1 May 21, 2015

Related U.S. Application Data

(63) Continuation-in-part of application No. 14/163,289, filed on Jan. 24, 2014, now Pat. No. 8,998,051, which is a continuation-in-part of application No. 13/483,264, filed on May 30, 2012, now Pat. No. 8,657,169, which is a continuation-in-part of application No. 12/765,437, filed on Apr. 22, 2010, now Pat. No. 8,281,970.

(60) Provisional application No. 61/214,483, filed on Apr. 24, 2009, provisional application No. 61/494,233, filed on Jun. 7, 2011.

(51) Int. Cl.
*A45F 3/04* (2006.01)
*A45F 3/08* (2006.01)
(Continued)

(52) U.S. Cl.
CPC ..... *A45F 3/14* (2013.01); *A45C 7/0086* (2013.01); *A45C 7/0095* (2013.01); *A45C 9/00* (2013.01); *A45C 11/20* (2013.01); *A45C 13/30* (2013.01); *A45C 13/36* (2013.01); *A45C 15/00* (2013.01); *A45F 3/02* (2013.01); *A45F 3/04* (2013.01); *A45F 3/047* (2013.01); *A47D 13/025* (2013.01); *A45C 2009/007* (2013.01); *A45F 3/08* (2013.01); *A45F 2003/003* (2013.01);
(Continued)

(58) Field of Classification Search
CPC ..... A45F 3/04; A45F 3/047; A45F 3/08; A47D 13/025
USPC ..... 224/153–156, 578–580, 627–659, 608, 224/612; D3/216, 217
See application file for complete search history.

(56) References Cited

U.S. PATENT DOCUMENTS 2,210,351 A 8/1940 Westendorf
4,458,834 A 7/1984 Rosen
(Continued)

FOREIGN PATENT DOCUMENTS

JP 2000 004917 A 1/2000

OTHER PUBLICATIONS http://www.ebay.com/item/Troy-Bilt . . . "Troy-Bilt TB4BPEC 32cc-4-Cycle Backpack Leaf Blower"; retrieved from Internet Nov. 21, 2014.
(Continued)

*Primary Examiner* — Justin Larson
(74) *Attorney, Agent, or Firm* — Hamilton, Brook, Smith & Reynolds, P.C.

(57) ABSTRACT

A backcarrying including a carrying portion having a top, a bottom, a front, a rear and two sides. A strap arrangement can also be included for carrying the carrying portion as a backcarrying. The strap arrangement can have a pair of carrying straps. Each carrying strap can be secured to the carrying portion at about the bottom and extend upwardly along respective sides of the carrying portion, and redirected at about the top of said respective sides to extend around to the rear of the carrying portion, and being redirected at about the top of the rear to extend downwardly for securement at about the bottom of the carrying portion at the rear. The strap arrangement can redirect forces to support a load in the carrying portion from the sides of the carrying portion.

20 Claims, 29 Drawing Sheets

(51) Int. Cl.

| | |
|---|---|
| ***A47D 13/02*** | (2006.01) |
| ***A45F 3/14*** | (2006.01) |
| ***A45C 7/00*** | (2006.01) |
| ***A45C 9/00*** | (2006.01) |
| ***A45C 11/20*** | (2006.01) |
| ***A45C 13/30*** | (2006.01) |
| ***A45C 13/36*** | (2006.01) |
| ***A45C 15/00*** | (2006.01) |
| ***A45F 3/02*** | (2006.01) |
| *A45F 3/00* | (2006.01) |

(52) U.S. Cl.
CPC .... *A45F 2003/045* (2013.01); *A45F 2003/142* (2013.01); *Y10T 29/49826* (2015.01)

(56) References Cited

U.S. PATENT DOCUMENTS

| | | | |
|---|---|---|---|
| 4,810,102 | A | 3/1989 | Norton |
| 4,826,060 | A | 5/1989 | Hollingsworth |
| 5,012,964 | A | 5/1991 | Falletta et al. |
| 5,415,332 | A | 5/1995 | Kliot |
| 5,431,317 | A | 7/1995 | Kliot |
| 5,547,051 | A | 8/1996 | Bartscht et al. |
| 5,577,652 | A | 11/1996 | Cooper |
| D383,305 | S | 9/1997 | Holstrom |
| 5,971,244 | A | 10/1999 | Jaeger |
| 5,988,474 | A | 11/1999 | Smith, II et al. |
| 6,164,505 | A | 12/2000 | Holter et al. |
| 6,164,509 | A | 12/2000 | Gausling et al. |
| 6,189,750 | B1 | 2/2001 | Von Neumann |
| 6,220,493 | B1 | 4/2001 | Iijima et al. |
| 6,257,472 | B1 | 7/2001 | Freedman |
| D452,993 | S | 1/2002 | Norman |
| 6,460,746 | B1 | 10/2002 | Amram |
| 6,772,883 | B2 | 8/2004 | Lindamood |
| 6,863,202 | B2 | 3/2005 | Ammerman |
| 6,889,882 | B1 | 5/2005 | Leep |
| 7,156,918 | B2 | 1/2007 | Marks |
| 7,160,028 | B1 | 1/2007 | Linday |
| 7,204,399 | B2 | 4/2007 | Collier et al. |
| 7,391,123 | B2 | 6/2008 | Rome |
| 7,404,506 | B1 | 7/2008 | Ross |
| 7,619,884 | B1 | 11/2009 | Gray |
| 8,998,051 | B2 | 4/2015 | Demskey |
| 2008/0277434 | A1 | 11/2008 | Sacks |
| 2009/0184143 | A1 | 7/2009 | Witt et al. |
| 2010/0213224 | A1 | 8/2010 | Barr |

OTHER PUBLICATIONS http://storemyfreeloader.com; "The Freeloader"—retrieved from Internet Dec. 1, 2014.

http://us.msasafety.com/Supplied-Air-Respiroartors; Self Contained Breathing Apparatus (SCBA)—retrieved from Internet Dec. 1, 2014.

Dunn, C., "Piezoelectric Backpack Concept: Take a Walk, Charge Your Gadgets", Retrieved online at www.treehugger.com/files/2007/10/piezoelectric_b.php (Oct. 9, 2007).

BACKPACK

RELATED APPLICATIONS

This application is a continuation-in-part of U.S. application Ser. No. Ser. No. 14/163,289, filed Jan. 24, 2104, now U.S. Pat. No. 8,998,051, issued Apr. 7, 2015, which is a continuation-in-part of U.S. application Ser. No. 13/483,264, filed May 30, 2012, now U.S. Pat. No. 8,657,169, issued Feb. 25, 2014, which is a continuation-in-part of U.S. application Ser. No. 12/765,437, filed Apr. 22, 2010, now U.S. Pat. No. 8,281,970, issued Oct. 9, 2012, which claims the benefit of U.S. Provisional Application No. 61/214,483, filed on Apr. 24, 2009. U.S. application Ser. No. 13/483,264 also claims the benefit of U.S. Provisional Application No. 61/494,233, filed on Jun. 7, 2011. The entire teachings of the above applications are incorporated herein by reference.

BACKGROUND

Backpacks in the prior art typically have shoulder straps which extend from the rear of the pack to allow the user to carry the pack. The weight is mostly borne from the top part of the backpack with the bulk of the weight in the backpack falling to the bottom, and outwards from the user's body at an offset distance from the body. If the weight in the backpack is heavy, the backpack can pull the user backwardly and become uncomfortable. The user usually has to lean forward to maintain balance and compensate for the load while walking.

SUMMARY

The present invention can provide a backpack which can distribute and carry weight better then prior backpacks, and therefore can carry more weight more comfortably. The backpack can include a pack portion having a top, a bottom, a front, a rear and two sides. A strap arrangement can also be included for carrying the pack portion as a backpack. The strap arrangement can have a pair of carrying straps. Each carrying strap can be secured to the pack portion at about the bottom and extend upwardly along respective sides of the pack portion, and redirected at about the top of said respective sides to extend around to the rear of the pack portion, and being redirected at about the top of the rear to extend downwardly for securement at about the bottom of the pack portion at the rear. The strap arrangement can redirect forces to support a load in the pack portion from the sides of the pack portion.

In particular embodiments, the pair of carrying straps can extend from a strap extending along the bottom of the pack portion and sewn to each side of the pack portion near the bottom to support the load from the bottom. Strap redirecting members can be secured to the pack portion at about the top of the pack portion on the two sides and at the rear, for redirecting each pack strap while allowing the carrying strap to slide through the redirecting members. A side ring can be secured to each side of the pack portion near the top through which a respective carrying strap passes and is slidably redirected. Two rear rings can be secured to the rear of the pack portion near the top, each through which a respective carrying strap passes and is slidably redirected. The side rings and the rear rings can be generally positioned on a common level. The rear rings can be positioned close to each other on opposite sides of a vertical center line, and the two carrying straps can be secured at about the bottom of the pack portion at the rear, and close to each other on opposite sides of the vertical center line. A stiffening member can be included for stiffening at least an upper portion of the rear of the pack portion. Each carrying strap can be secured to the rear of the pack portion, at about the bottom with a releasable connector. Each rear ring can be secured to the rear of the pack portion near the top by a releasable connector. The strap arrangement can be disconnected from the backpack configuration and reconnected in a shoulder strap configuration. Each carrying strap can include at least one strap adjuster for adjusting the strap. The strap arrangement can include piezoelectric material for generating electricity. A solar cell system can be included on the pack portion.

The present invention can also provide a backpack having a pack portion formed of flexible material having a top, a bottom, a front, a rear, and two sides. A stiffening member can be secured to the rear for stiffening at least an upper portion of the pack portion. Strap redirecting members can be secured to the pack portion at about the top of the pack portion on the sides and at the rear, with a side strap redirecting member on each side, and two rear strap redirecting members at the rear which are also secured to the stiffening member. A strap arrangement can be included for carrying the pack portion as a back pack. The strap arrangement can have a pair of carrying straps. Each carrying strap can extend from the bottom of the pack portion and extend upwardly along respective sides of the pack portion, and redirected at about the top of said respective sides by the two side strap redirecting members to extend around to the rear of the pack portion, and being redirected at about the top of the rear by respective rear strap redirecting members to extend downwardly for securement at about the bottom of the pack portion at the rear. The strap arrangement can redirect forces to support a load in the pack portion from the bottom and sides of the pack portion.

The present invention can also provide a method of forming a backpack, including providing a pack portion having a top, a bottom, a rear and two sides. A strap arrangement can be secured to the pack portion for carrying the pack portion as a backpack. The strap arrangement can have a pair of carrying straps secured to the pack portion at about the bottom and extending upwardly along respective sides of the pack portion, and redirected at about the top of said respective sides to extend around to the rear of the pack portion, and being redirected at about the top of the rear to extend downwardly for securement at about the bottom of the pack portion at the rear. The strap arrangement can redirect forces to support a load in the pack portion from the sides of the pack portion.

In particular embodiments, the pair of carrying straps can extend from a strap extending along the bottom of the pack portion and sewn to each side of the pack portion near the bottom to support the load from the bottom. Strap redirecting members can be secured to the pack portion at about the top of the pack portion on the two sides and at the rear, for redirecting each carrying strap while allowing the carrying strap to slide through the redirecting member. A side ring can be secured to each side of the pack portion near the top through which a respective carrying strap passes and is slidably redirected. Two rear rings can be secured to the rear of the pack portion near the top, each through which a respective carrying strap passes and is slidably redirected. The side rings and the rear rings can be positioned generally on a common level. The rear rings can be positioned close to each other on opposite sides of the vertical center line, and the two carrying straps can be secured at about the bottom of the pack portion at the rear, and close to each other on opposite sides of the vertical center line. At least an upper portion of the rear of the pack portion can be stiffened with a stiffening member. Each carrying strap can be secured to the rear of the pack portion at about the bottom with a releasable connector. Each rear ring can be secured to the rear of the pack portion near the top by a releasable connector. The strap arrangement can be configured to be capable of being disconnected from the backpack configuration and reconnected in a shoulder strap configuration. Each carrying strap can be provided with at least one strap adjuster for adjusting the strap. The strap arrangement can be provided with piezoelectric material for generating electricity. A solar cell system can be positioned on the pack portion.

The present invention can also provide a method of using a backpack including providing a pack portion having a top, a bottom, a rear, and two sides. A strap arrangement can be secured to the pack portion for carrying the pack portion as a backpack. The strap arrangement can have a pair of carrying straps secured to the pack portion at about the bottom and extending upwardly along respective sides of the pack portion, and redirected at about the top of said respective sides to extend around to the rear of the pack portion, and being redirected at about the top of the rear to extend downwardly for securement at about the bottom of the pack portion at the rear. The strap arrangement can redirect forces to support a load in the pack portion from the sides of the pack portion.

In some embodiments, the strap arrangement of the backpack can have at least one rear ring that is a single ring rotatably secured to a stiffening member. The stiffening member can stiffen at least an upper portion of the rear of the pack portion. A support strap can be secured to the stiffening member. The support strap can include a bottom portion for extending along the bottom of the pack portion at the front, two side portions extending from opposite ends of the bottom portion to opposite ends of the stiffening member in an angled manner, and an upper portion for extending along and mounting against the stiffening member.

The present invention can also provide backpack including a pack portion formed of flexible material having a top, a bottom, a front, a rear, and two sides. A stiffening member can be secured to the rear for stiffening at least an upper portion of the pack portion. Strap redirecting members can be secured to the pack portion at about the top of the pack portion on the sides and at the rear. A side strap redirecting member can be on each side, and a rear strap redirecting member can be at the rear and rotatably secured to the stiffening member. A strap arrangement can be included to carry the pack portion as a backpack. The strap arrangement can include a pair of carrying straps. Each carrying strap can extend from the bottom of the back portion and extend upwardly along respective sides of the pack portion, and redirected at about the top of the respective sides by the two sides strap redirecting members to extend around to the rear of the pack portion, and redirected at about the top of the rear by the rear strap redirecting member to extend downwardly for securement at about the bottom of the pack portion at the rear. In addition, a support strap can be secured to the stiffening member, for providing support to the bottom of the pack portion. The support strap can include a bottom portion for extending along the bottom of the pack portion at the front, two side portions extending from opposite sides of the bottom portion to opposite ends of the stiffening member in an angled manner, and an upper portion for extending along and mounting against the stiffening member. The strap arrangement can redirect forces for supporting a load in the pack portion from the bottom and sides of the pack portion.

The backpack in the present invention has a design that better distributes or carries weight than prior backpacks, and allows user and the backpack to carry weight more comfortably than conventional packs and in an upright position. Also, the backpack can be carried higher on the back and shoulders of the user. In addition, the backpack can be more stable since the straps can extend on the sides, and is less susceptible to wriggling or swinging.

In particular embodiments, the strap arrangement can relieve stress on the user's shoulders and neck muscles by spreading, redistributing or distributing stress or forces that in prior art backpacks would cause pressure points of discomfort on the shoulders and neck, outwardly horizontally along the stiffening member, and can allow the user's upper body to more evenly carry the load in the pack portion. Stability in the backpack can in some embodiments, come from load forces being spread, redistributed or distributed, in a circular path or motion towards the central, vertical lengthwise core of the user's upper body. The backpack can also be more comfortable when the user is leaning forward, such as on a bicycle. The fit of the shoulder straps can be reinforced with a waist strap, and the pack portion can be prevented or minimized from sliding forward while the user is leaning forward, such as on a bicycle, or from falling off the shoulders at a back angle, such as while climbing up objects, for example, climbing walls. The shoulder straps can be less susceptible to coming off from wriggling or swinging, since the shoulder straps can wrap around the shoulders from the neck, back down and over towards the lower middle of the back. Internal reinforcement of the pack portion can also aid in distributing the load.

The present invention can also provide a carrying pack including a pack portion having a top, a bottom, a front, a rear, and two sides. A strap arrangement can be included for enabling carrying of the pack portion on a body of a user. The strap arrangement can include a pair of carrying straps. Each carrying strap can be secured to the pack portion to at least one of the bottom and sides and extend upwardly along respective sides of the pack portion. Strap redirecting members can be secured to the pack portion at upper regions of the pack portion on the two sides and at the rear, redirecting each carrying strap while allowing the carrying straps to move through the redirecting members, and being redirected at upper regions of the respective sides to extend around to the rear of the pack portion, and being redirected at upper regions of the rear to extend downwardly for securement at lower regions of the pack portion at the rear. The strap arrangement can redirect forces for supporting a load in the pack portion from the sides of the pack portion.

In particular embodiments, the pair of carrying straps can extend from a strap extending along the bottom of the pack portion and secured to lower regions of each side of the pack portion, to support the load from the bottom. A side ring can be secured to upper regions of each side of the pack portion through which a respective carrying strap can pass and be slidably redirected. At least one rear ring can be secured to upper regions of the rear of the pack portion through which the carrying straps can pass and be slidably redirected. The side rings and the at least one rear ring can be generally positioned on a common level. The pair of carrying straps can pass through the at least one rear ring close to each other on opposite sides of a vertical centerline. The pair of carrying straps can be secured at lower regions of the pack portion at the rear close to each other on opposite sides of the vertical centerline. A stiffening member can be included for stiffening at least an upper portion of the rear of the pack portion. The at least one rear ring can be a single ring rotatably secured to the stiffening member. A support strap can be secured to the stiffening member. The support strap can include a bottom portion extending along the bottom of the pack portion at the front. Two side portions can extend from opposite sides of the bottom portion to opposite ends of the stiffening member in an angled manner, and an upper portion can extend along and be mounted against the stiffening member. The strap arrangement can include piezoelectric material for generating electricity. The carrying pack can be at least one of a backpack, a front pack, and a child carrier.

The present invention can also provide a strap arrangement for carrying a pack portion as a carrying pack. The pack portion can have a top, a bottom, a front, a rear, and two sides. The strap arrangement can include a pair of carrying straps. Each carrying strap for securing to the pack portion to at least one of the bottom and sides and for extending upwardly along respective sides of the pack portion. Strap redirecting members can be securable to the pack portion at upper regions of the pack portion on the two sides and at the rear, for redirecting each carrying strap while allowing the carrying straps to move through the redirecting members, for being redirected at upper regions of both respective sides to extend around to the rear of the pack portion, and being redirected at upper regions of the rear to extend downwardly for securement at lower regions of the pack portion at the rear. The strap arrangement can redirect forces for supporting a load in the pack portion from the sides of the pack portion.

In particular embodiments, piezoelectric material can be included for generating electricity.

The present invention can also provide a method of forming a carrying pack including providing the pack portion having a top, a bottom, a rear and two sides. A strap arrangement can be secured to the pack portion for enabling carrying of the pack portion on a body of a user. The strap arrangement can include a pair of carrying straps secured to the pack portion to at least one of the bottom and sides and extending upwardly along respective sides of the pack portion. Strap redirecting members can be secured to the pack portion at upper regions of the pack portion on the two sides and at the rear, redirecting each carrying strap while allowing the carrying straps to move through the redirecting members, and being redirected at upper regions of the respective sides to extend around to the rear of the pack portion, and being redirected at upper regions of the rear for extending downwardly for securing at lower regions of the pack portion at the rear. The strap arrangement can redirect forces for supporting a load from the sides of the pack portion.

In particular embodiments, the pair of carrying straps can extend from a strap extending along the bottom of the pack portion and can be secured to the lower regions of each side of the pack portion, to support the load from the bottom. A side ring can be secured to upper regions of each side of the pack portion through which a respective carrying strap can pass and can be slidably redirected. At least one rear ring can be secured to upper regions of the rear of the pack portion, through which the carrying straps can pass and can be slidably redirected. The side rings and the at least one rear ring can be positioned generally on a common level. The pair of carrying straps can pass through the at least one rear ring close to each other on opposite sides of a vertical centerline. The pair of carrying straps can be secured at lower regions of the pack portion at the rear close to each other on opposite sides of the vertical centerline. Stiffening can be provided at least on an upper portion of the rear of the pack portion with a stiffening member. The at least one rear ring can be a single ring that is rotatably secured to the stiffening member. A support strap can be secured to the stiffening member. The support strap can include a bottom portion extending along the bottom of the pack portion at the front. Two side portions can extend from opposite ends of the bottom portion to opposite ends of the stiffening member in an angled manner, and an upper portion can extend along and be mounted against the stiffening member. The strap arrangement can be provided with piezoelectric material for generating electricity. The carrying pack can be formed as at least one of a backpack, a front pack, and a child carrier.

The present invention can also provide a carrying apparatus including a carrying portion having a top, a bottom, a front, a rear, and two sides. A strap arrangement can enable carrying of the carrying portion on a body of the user. The strap arrangement can include a pair of carrying straps, each carrying strap can be secured to the carrying portion to at least one of the bottom and sides, and extend upwardly along respective sides of the carrying portion. The strap arrangement can further include strap redirecting members secured to the carrying portion at upper regions of the carrying portion on the two sides and at the rear, redirecting each carrying strap while allowing the carrying strap to move through the redirecting members and being redirected at upper regions of respective sides to extend around to the rear of the carrying portion, and being redirected at upper regions of the rear to extend downwardly for securement at lower regions of the carrying portion at the rear. The strap arrangement can redirect forces for supporting a load in the carrying portion from the sides of the carrying portion.

In particular embodiments, the pair of carrying straps can extend from a strap extending along the bottom of the carrying portion and extend to lower regions of each side of the carrying portion to support the load from the bottom. A side ring can be secured to upper regions of each side of the carrying portion through which a respective carrying strap can pass and be slidably redirected. At least one rear ring can be secured to upper regions of the rear of the carrying portion through which the carrying straps pass and are slidably redirected. The pair of carrying straps can pass through the at least one ring close to each other on opposite sides of a vertical centerline. The pair of carrying straps can be secured at lower regions of the carrying portion at the rear close to each other on opposite sides of the vertical centerline. The at least one ring can be rotatably secured to a stiffening member. The stiffening member can stiffen at least an upper portion of the rear of the carrying portion. A support strap can be secured to the stiffening member. The support strap can include a bottom portion extending along the bottom of the carrying portion at the front. Two side portions can extend from opposite ends of the bottom portion to opposite ends of the stiffening member in an angled manner, and an upper portion can extend along and mount against the stiffening member. In some embodiments, the carrying portion can include rigid rear, side and bottom structural members. The strap redirecting members can be secured to selected rigid rear and side structural members. In some embodiments, the carrying portion can form a frame on the bottom, rear and two sides, for carrying desired items. In other embodiments, the carrying portion can be a child carrier seat in which the bottom, rear and two sides are formed of rigid and/or semirigid material. The strap arrangement can include piezo electric material for generating electricity.

The present invention can also provide a strap arrangement for carrying a carrying portion as a carrying apparatus. The carrying portion can have a top, a bottom, a front, a rear, and two sides. The strap arrangement can include a pair of carrying straps, each carrying strap for securing to the carrying portion to at least one of the bottom and sides for extending upwardly along respective sides of the carrying portion. The strap arrangement can further include strap redirecting members securable to the carrying portion at upper regions of the carrying portion on the two sides and at the rear, for redirecting each carrying strap while allowing the carrying straps to move through the redirecting members for being redirected at upper regions of the respective sides to extend around to the rear of the carrying portion, and being redirected at upper regions of the rear to extend downwardly for securement at lower regions of the carrying portion at the rear. The strap arrangement can redirect forces for supporting a load in the carrying portion from sides of the carrying portion.

In particular embodiments, piezoelectric material can be included for generating electricity.

The present invention can also provide a method of forming a carrying apparatus including providing a carrying portion having a top, a bottom, a rear and two sides. A strap arrangement can be secured to the carrying portion for enabling carrying of the carrying portion on a body of the user. The strap arrangement can include a pair of carrying straps secured to the carrying portion to at least one of the bottom and sides and extend upwardly along respective sides of the carrying portion. The strap arrangement can further include strap redirecting members which are secured to the carrying portion at upper regions of the carrying portion on the two sides and at the rear, redirecting each carrying strap while allowing the carrying straps to move through the redirecting members and being redirected at upper regions of the respective sides to extend around to the rear of the carrying portion, and being redirected at upper regions of the rear for extending downwardly for securement at lower regions of the carrying portion at the rear. The strap arrangement can redirect forces for supporting a load from the sides of the carrying portion.

In particular embodiments, the pair of carrying straps can be extended from a strap extending along the bottom of the carrying portion and to lower regions of each side of the carrying portion to support the load from the bottom. A side ring can be provided that is secured to upper regions of each side of the carrying portion through which a respective carrying strap passes and is slidably redirected. At least one rear ring can be provided that is secured to upper regions of the rear of the carrying portion, through which the carrying straps pass and are slidably redirected. The pair of carrying straps can be positioned to pass through the at least one rear ring close to each other on opposite sides of a vertical centerline. The pair of carrying straps can be secured at lower regions of the carrying portion at the rear close to each other on opposite sides of the vertical centerline. Stiffening can be provided for at least an upper portion of the rear of the carrying portion with a stiffening member. The at least one rear ring can be rotatably secured to the stiffening member. A support strap can be secured to the stiffening member. The support strap can include a bottom portion extending along the bottom of the carrying portion at the front. Two sides can extend from opposite ends of the bottom portion to opposite ends of the stiffening member in an angled manner, and an upper portion can extend along and mount against the stiffening member. In some embodiments, the carrying portion can be provided with rigid rear, side and bottom structural members and the strap redirecting members can be secured to selected rigid rear and side structural members. In some embodiments, the carrying portion can be provided as a frame on the bottom, rear and two sides, for carrying desired items. In other embodiments, the carrying portion can be provided as a child carrier seat in which the bottom, rear and two sides can be formed of rigid and/or semirigid material. The strap arrangement can be provided with piezoelectric material for generating electricity.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
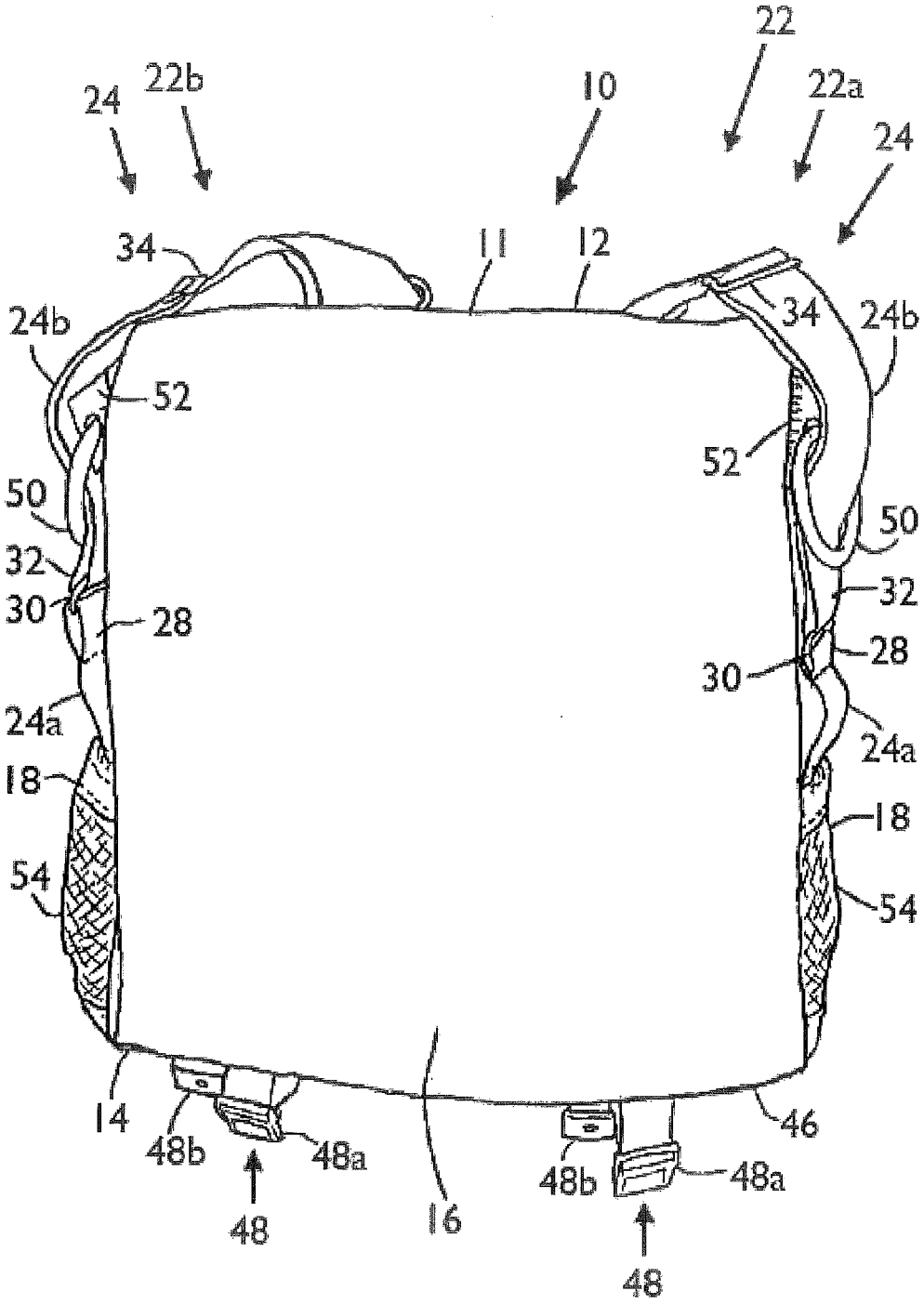
FIG. 1 is a front view of an embodiment of a backpack in the present invention.

Referring to FIGS. 1-8, backpack 10 is one embodiment of a backpack in the present invention and can include a pack portion 11, and a strap arrangement or assembly 22 for carrying the pack portion 11 as a backpack. The pack portion 11 can be made of flexible material suitable for a backpack, for example, nylon, denim, canvass, etc. The pack portion 11 can be generally square or rectangular and can have a top 12, a bottom 14, a front 16, a rear 20 and two sides 18 formed from the flexible material.

Figure 2:
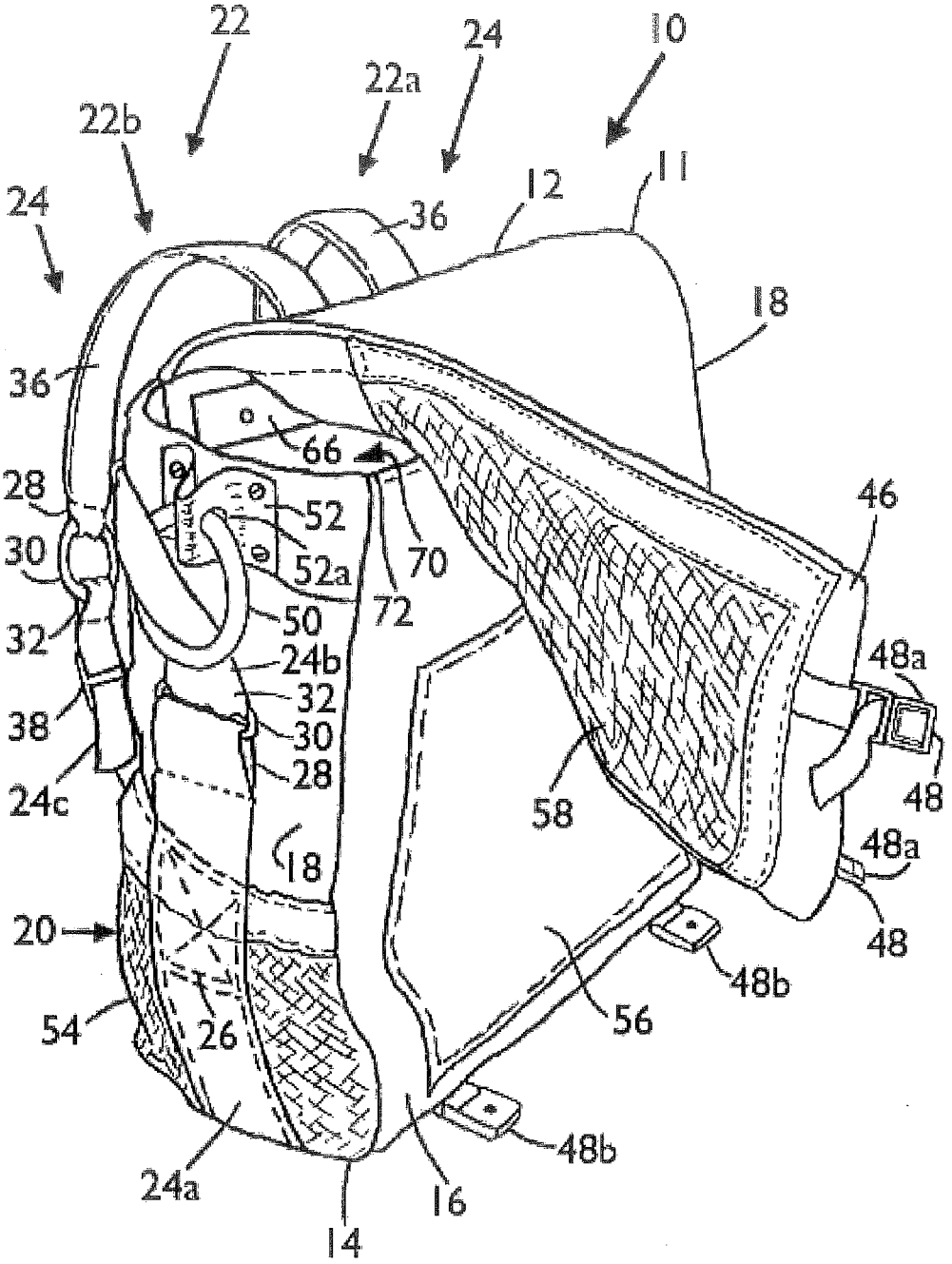
FIG. 2 is a front perspective view of the backpack.
Figure 4:
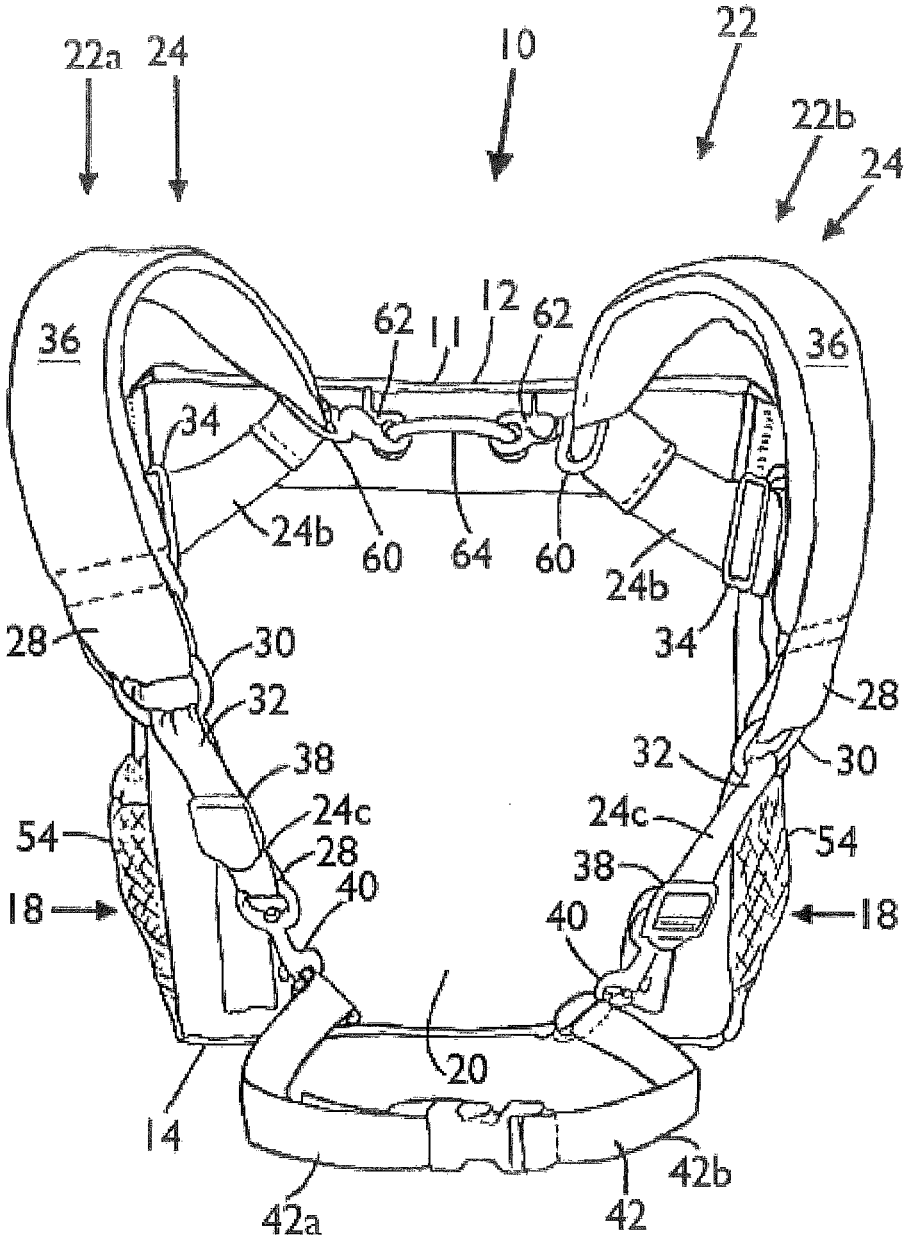
FIG. 4 is a rear view of the backpack.
Figure 8:
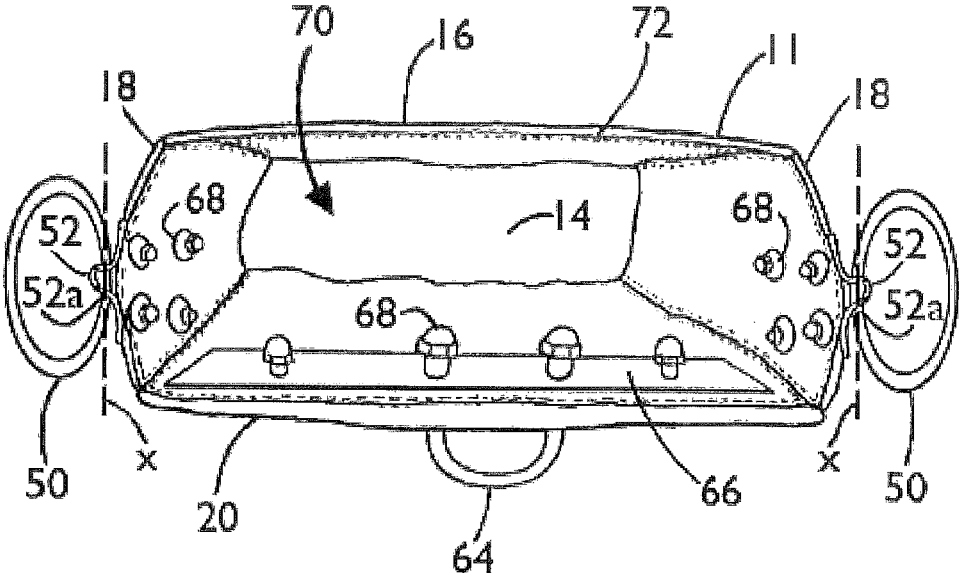
FIG. 8 is an interior view of the backpack with the strap arrangement omitted.

Referring to FIGS. 2 and 8, at least the upper portion of the rear 20 of the pack portion 11 can be stiffened or braced by a stiffening member 66. The stiffening member 66 can be a lateral or horizontally placed member of stiff material composition which can extend laterally across the width of the rear 20, a substantial portion or the majority of the width, or at least a portion of the width. The stiffening member 66 can be a metallic bar, such as steel, aluminum, titanium, etc, which can be secured by fasteners 68 to the interior of the rear 20, for example, by screws, bolts or rivets, as shown. The bar can be solid, perforated with holes, or can be hollow tubing. Alternatively, the stiffening member 66 can be held in place by adhesives, or sewn or held in a pocket, and can be on the exterior of the rear 20. In some embodiments, the stiffening member 66 can be made of other suitable materials and can be plastic, wood, paperboard, or composites, such as fiberglass or carbon fiber, and can be a plate or a board having a shape extending both laterally and vertically. A handle or ring 64 can be secured to stiffening member 66 and can extend from the rear 20 on the exterior side (FIG. 4).

Figure 3:
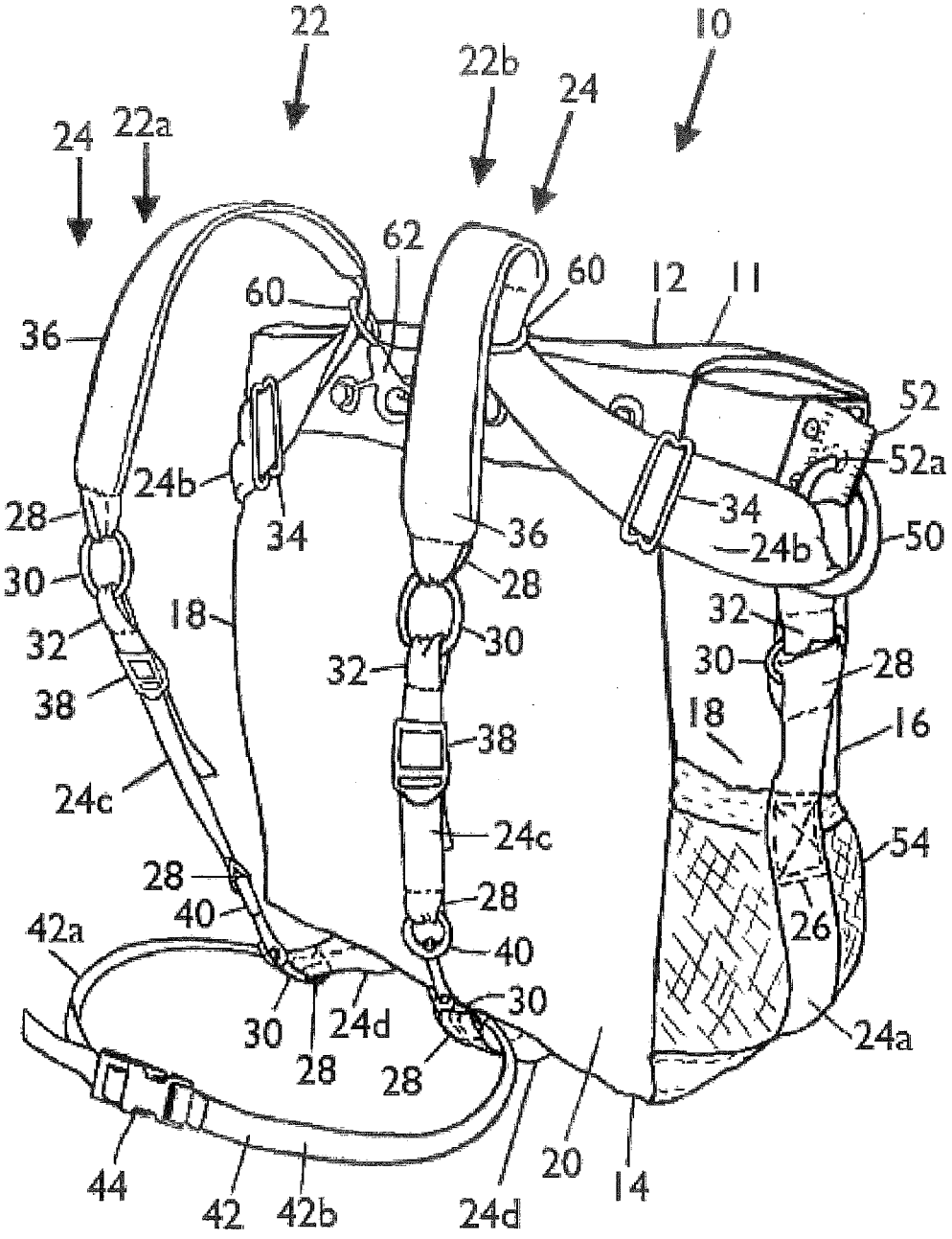
FIG. 3 is a rear perspective view of the backpack.

The strap arrangement 22 can include a right shoulder strap 22*a* and a left shoulder strap 22*b*, and each can consist of a length of strap 24 which can be formed of one or more strap segments. Referring to FIGS. 1-3, each strap 24 can extend upwardly from the sides 18 of the pack portion 11 from a strap segment 24*a*. The strap segment 24*a* can extend along the bottom 14 of the pack portion 11 (FIGS. 5 and 6) and can be sewn or stitched with stitching 26 on the bottom 20 and on the sides 18 near the bottom 20. Each strap 24 can extend along the central axis C (FIG. 9) up the sides 18 and through a side strap redirecting or pulley member 50 such as a ring, which can be secured near the top of the sides 18 along the central axis C by a mount 52. The mount 52 can rotatably support the ring 50 through a hole 52*a* on a horizontal axis X which allow the ring to pivot about axis X up and down, in a pivoting or rotational degree of freedom with the opening of the ring facing generally vertically for accepting the strap 24.

Figure 10:
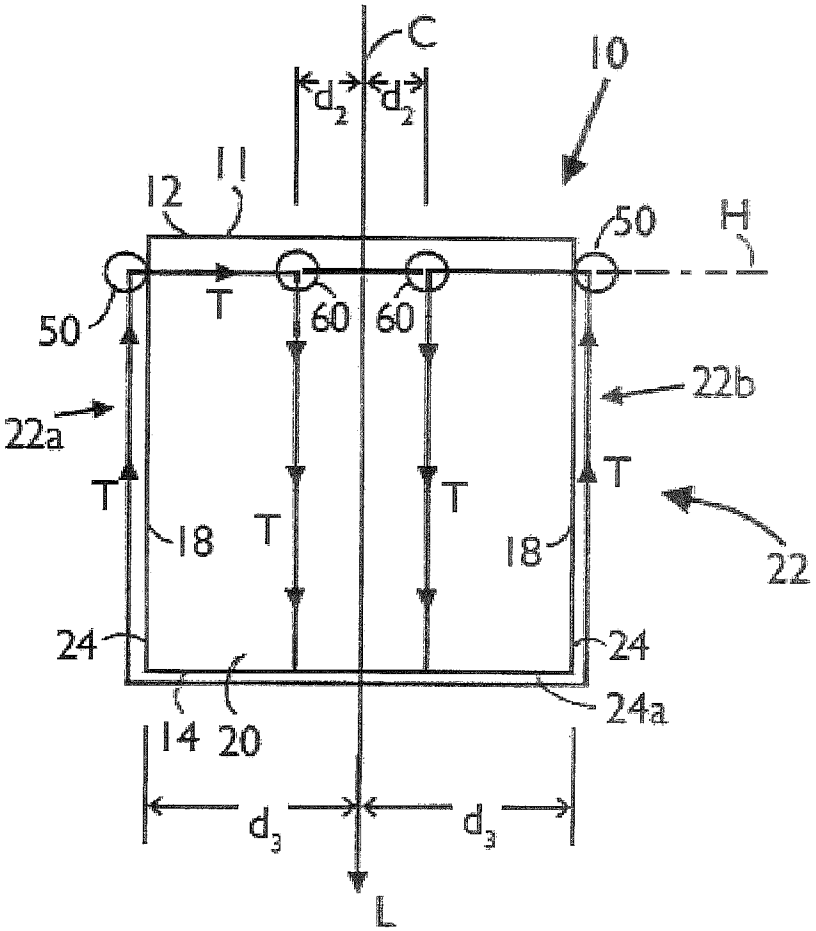
FIG. 10 is a rear schematic drawing of an embodiment of the backpack.

Each strap 24 that passes through the opening of the side strap redirecting member or ring 50 can be redirected at about a 90° or right angle from about a vertical orientation to about a horizontal or lateral orientation, before extending around the sides 18 to the rear 20 of the pack portion 11 around the exterior of the pack portion 11 in a manner that can make about a 90° or right angle lateral change in direction. Referring to FIGS. 3 and 4, the straps 24 can then extend generally laterally to two rear strap redirecting or pulley members 60, such as rings, near the top of the rear 20. The two rear rings 60 can be located close to each other and spaced apart on opposite sides of the central axis C (FIG. 10). The openings of the rear rings can face generally horizontally for accepting the straps 24. The straps 24 pass through the openings of the rear strap redirecting members or rings 60 and then can be redirected at about a 90° or right angle from about a lateral or horizontal orientation to about a vertical orientation, to extend downwardly to the bottom 14 at the rear 20, where the straps 24 are secured and spaced apart from each other on opposite sides of central axis C.

Figure 9:
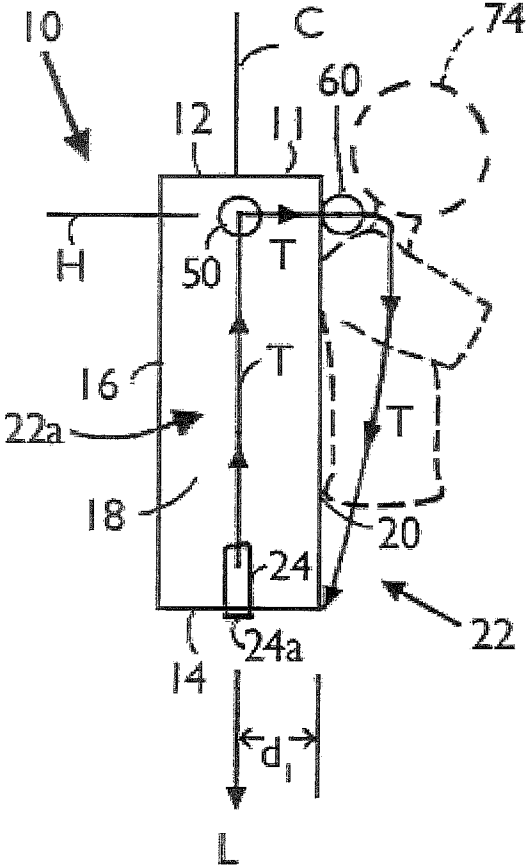
FIG. 9 is a side schematic drawing of an embodiment of the backpack.

Referring to FIGS. 9 and 10, the mechanics of the strap arrangement 22 can be seen. Referring to the side view of FIG. 9, the center of the weight of load L in the pack portion 11 is directed downwardly generally from the center of the pack portion 11, and is shown being on the central vertical axis or center line C. The load L is offset from the rear 20 of the pack portion 11 and the back of the user 74 by a rearwardly lateral offset distance of $d_1$. In a conventional backpack where the straps extend from the rear of the backpack, the center of the load L would typically act on the user 74 at the offset $d_1$ from the user's body and if the load L were heavy, the user 74 would typically have to lean forward to counteract the offset load and the moment arm force it forms, which tends to pull the user 74 backwardly. However, in the backpack 10, the straps 24 of the right 22*a* and left 22*b* shoulder straps can be secured to the sides 18 of the pack portion 11, near the bottom 14 in a centered manner, and extend upwardly along the sides 18 along the vertical central axis C of the pack portion 11. As a result, the center of the downward load L can be supported on the two opposite sides 18 by each strap 24 which is located at about the center of the load L at the vertical central axis C and at the offset distance $d_1$. By supporting the center of the load L at the offset distance $d_1$, the effects of the offset distance can be compensated for. Each strap 24 can carry half the load L (½ L), resulting in each strap 24 having a tension T from supporting its share of the load L. When the straps 24 extend from a strap segment 24*a* that extends along the bottom 14 of the pack portion 11 from one side 18 to the other side 18, the straps 24 can also carry or assist carrying the load L from the bottom 14 of the pack portion 11. The strap segment 24*a* can extend along the center of the bottom 14 at or on the center axis C, as seen in FIG. 9 to support the load L from the bottom 14 at the center of the load.

When the straps 24 reach about the top of the sides 18, the straps 24 each pass through a side strap redirecting member 50, such as the opening of a ring, and can be slidably redirected generally laterally rearwardly along the sides 18. The side strap redirecting members 50 can redirect the straps 24 and the tension T from a vertical direction to a generally lateral or horizontal direction relative to sides 18. Using rings as the side strap redirecting members 50 can allow the straps 24 to slide relative to the rings, thereby slidably changing direction in a manner that allows the tension T in the straps 24 to be transmitted on the other side of the rings in a pulley or pulley like manner. The straps 24 and the tension T can wrap around the rear corners of the pack portion 11, changing direction laterally in about a right angle, and, moving rearwardly from the sides 18 to inwardly along the rear 20. The straps 24 can extend generally laterally inwardly across the rear 20 as seen in FIG. 10, before reaching a rear strap redirecting member 60 and can be slidably redirected at about a right angle from a generally inward lateral or horizontal moving direction to a generally downward vertical direction, and then can be secured at about the bottom of the pack portion 11 at the rear 20. Using rings as the rear strap redirecting members 60 can allow the straps 24 to slide relative to the rings thereby slidably changing direction in a pulley or pulley like manner to transmit the tension T on the strap 24 from about a horizontal direction to about a downward vertical direction, at the rear 20 of the pack portion 11. The two vertical portions of the straps 24 of the right 22*a* and left 22*b* shoulder straps are typically the portions of the straps 24 that are worn on the shoulders of the user 74. The stiffing member 66 can define a stiffened or rigid width of the rear 20 to prevent the sides 18 from collapsing inwardly from the tension T of the straps 24.

Although the load L of the pack portion 11 is centered at an offset distance $d_1$ from the rear 20 of the pack portion 11 and the back of the user 74, which would normally form a moment arm force to pull the user 74 backwardly, the effects of the offset distance $d_1$ can be minimized or compensated by the straps 24 of the right 22*a* and left 22*b* shoulder straps extending upwardly along the sides 18 along the vertical central axis C to support the center of the load L along the sides 18 on the center or on axis C. The tension T on the two straps 24 supporting the load L can be transmitted upwardly along the straps 24 to about the top of the sides 18, where it is redirected generally laterally by the side strap redirecting members 50 around to the rear 20 and downwardly by the rear strap redirecting members 60. As a result, when the user 74 wears the right 22*a* and left 22*b* shoulder straps, the load L in the backpack 10 is transmitted by the redirected straps 24 and the tension T, from the center of the sides 18 to the portions of the straps 24 worn by the user 74, in a manner which can compensate for the offset distance $d_1$. By compensating for the offset distance $d_1$ by redirecting tension T, heavy loads can be carried, since typical moment arm forces which are formed by the offset distance in traditional packs are generally not formed. The strap redirecting members 50 and 60 can be positioned generally along a common horizontal plane or level H near the top of the pack portion 11, to prevent or minimize tilting of the pack portion 11 during use. Referring to FIG. 10, the rear strap redirecting members 60 can be spaced apart from each other and positioned on opposite sides of the vertical central axis C by a distance $d_2$. This distance $d_2$ can vary, and can be, for example, often between 1-5 inches for a pack portion 11 about 12-18 inches wide. The stiffening member 66 can stiffen the width of the rear 20 near the top and can maintain a desired position and/or spacing for the rear strap redirecting members 60. The two straps 24 can be secured at about the bottom by about the same distance $d_2$. By redirecting the two straps 24 close to and on opposite sides of the vertical central axis C, the load L of the pack portion 11 also can be transmitted by the tension T in the straps 24 close to the spine of the user 74 and on opposite sides by the distance $d_2$, thereby minimizing moment arm forces on the user 74 in the lateral side to side direction, which can also make it easier to carry heavier loads. The close positioning of the straps 24 relative to each other can help prevent the pack portion 11 from sliding off the user's 74 shoulders unintentionally. With the load L also being supported at the sides 18 of the pack portion 11 by the two straps 24 which are at the lateral sideward distance $d_3$ from the vertical central axis C, side wiggling or swinging can also be minimized. It is believed that such swinging can be caused by moment arm forces that are laterally sideward offset from the vertical central axis C, and with the straps 24 being positioned at the sides 18 by the distance $d_3$, such moment arm forces can be carried and compensated by this location of the straps 24. It is also believed that the horizontal rearwardly redirection of the straps 24 and tension T at the top of the sides 18 can pull the top of the pack portion 11 tighter or closer and higher on the back of the user 74.

Additional details of particular embodiments now follows. In some embodiments, the pack portion 11 can have a height of 14-24 inches, a width of 12-20 inches and a depth of 4-8 inches, but can vary depending upon the situation. Different sizes can result from proportional sizing to fit a user's body, for example, small, medium, large or extra large sizes. The opening 72 to the interior 70 of the pack portion 11 (FIGS. 2 and 8) can be located at the top 12 and can be closed or covered with a flap 46. The flap can extend from the rear 20 over the front 16 of the pack portion 11, and can be secured by two adjustable securement clips 48, having a portion 48*a* on the flap 46 and a portion 48*b* on the pack portion 11. The front 16 and the interior of the flap 46 can each have a storage pocket 58. The storage pocket 58 can be made of netting or mesh material. The sides 18 can each have a pocket 54 at the bottom portion which can be mesh or netting, and extend over the straps 24. FIGS. 2 and 3 show the pockets 54 with portions broken away to show the underlying straps 24 for illustration purposes.

The straps 24 of the right 22*a* and left 22*b* shoulder straps can be formed of strap segments 24*a*, 24*b*, 24*c*, and 24*d*. Strap segment 24*a* can be a single strap that can extend along the center of the bottom 14 of the pack portion 11 and around the ends of the bottom 14 upwardly along the center of the sides 18. In other embodiments, strap segment 24*a* can have multiple straps. The strap segment 24*a* can be secured to each side 18 near the bottom, for example, by stitching 26 at about the lower third, or by other suitable means. The two opposite ends of the segment 24*a* can have a loop 28 secured to a ring 30 which connects each end of the strap segment 24*a* to a strap segment 24*b*, about halfway up the sides 18, before reaching the side strap redirecting members 50. Each strap segment 24*b* can be secured to the ring 30 by a loop 32, which can be adjusted by a strap adjuster 34, for adjusting the length of strap segment 24*b*. The strap segments 24*b* can each have a padded section 36 below the rear strap redirecting members 60 to provide comfort for the user 74. The ends of the strap segments 24*b* can have a loop 28 secured to a ring 30 which can connect to a strap segment 24*c*. Each strap segment 24*c* can be secured to a ring 30 by a loop 32 which can be adjusted by a strap adjuster 38 for adjusting the length of strap segment 24*c*. Having adjustability in both strap segments 24*b* and 24*c* can provide the user 74 with adjustment flexibility for making more precise adjustments for users of different body types or walks. The ends of each strap segment 24*c* can have a loop 28 secured to a releasable connector 40, that can have an openable ring or fastener, which can be spring loaded. Each releasable connector 40 can releasably secure a strap segment 24*c* to a strap segment 24*d*, thereby releasably securing the straps 24 to about the bottom of the pack portion 11 at the rear 20. Each strap segment 24*d* can be stitched with stitching 26 to and extend tranversely along the bottom 14 from about the center of the bottom 14 to the edge of the rear 20, after which a loop 28 secured to a ring 30 can extend. The releasable connectors 40 of strap segments 24*c* can connect to strap segments 24*d* by engaging the rings 30, which also allows for quick release at the bottom middle for easy removal of the pack portion 11. The strap segments 24*d* can be spaced apart by the distance $d_2$. The straps segments 24*a* and 24*d* can be stitched or attached to the bottom 14 and sides 18 of the pack portion 11 generally or mostly at non seam locations so that the strap segments 24*a* and 24*d* do not tear at seams when carrying weight.

A waist strap 42 can have portions 42*a* and 42*b* which are secured to the rings of strap segments 24*d*. The waist strap 42 can allow securement to the waist of the user 74 and can include a releasable latch 44. The waist strap 42 can pull the straps 24 closer together to the user's 74 shoulders in an inward fashion which can aid or help keep the straps 24 from sliding off the shoulders, and can further reinforce the circular grip of the shoulder straps 22*a* and 22*b* around the shoulders and body of the user 74, by anchoring the bottom end of the pack portion 11 around the waist. The waist strap 42 can attach at the same points at the rear 20 of the pack portion 11, as the shoulder straps 22*a* and 22*b*, and can be positioned to achieve near central placement of the shoulder straps 22*a* and 22*b*. The pack portion 11 can be prevented from sliding forward the same amount as conventional backpacks when the user 74 is leaning forward, since the strap arrangement 22 can fit around the shoulders of the user 74 back down to the waist via the top and bottom with a centralized directionality.

The mounts 52 for the side strap redirecting members 50 can be secured to the sides 18 by fasteners 68, such as screws, bolts or rivets. The mounts 52 can be mounted to the sides 18 over a rectangular or square region of the sides 18 to provide some rigidity or stiffness at the top of the sides 18. A handle 64 can be secured to the stiffening member 66 and extend from the rear 20 in a manner that is centered about axis C. The handle 64 can allow the pack portion 11 to be easily picked up by the user 74 and can also serve as a mount or securement location for the rear strap redirecting members 60 for desired positioning. Each rear strap redirecting member 60 can consist of a ring that is connected to a releasable connector 62, that can have an openable ring or fastener which can be spring loaded. The handle 64 can be sized to allow the rings 60 to be spaced apart from axis C by distance $d_2$. The handle 64 can be metal or plastic, but in some embodiments, can be fabric. The releasable connectors 62 can swivel to provide the rings 60 with freedom of movement. With the rear strap redirecting members 60 being secured to the handle 64, which in turn can be secured to the stiffening member 66, the load borne by the straps 24 can be transferred by the rear strap directing members 60 to the stiffening member 66. This can also prevent or minimize the load L from acting on or tearing at seams of the pack portion 11. In the embodiment shown in the drawings the strap redirecting members 60 have been shown as rings, and the rings can have round or flattened openings. In some embodiments, rollers can be provided to reduce friction. In other embodiments, the rings can be replaced by other suitable redirecting structures, including bands or loops of material or fabric through which the straps 24 can pass, roller pulleys, etc. Some embodiments of the redirecting members can slide easily, and others may slide very little or none at all. The hardware for the backpack 10, such as rings, adjusters, latches, releasable connectors, etc., can be standard components that are commercially available.

Figure 11:
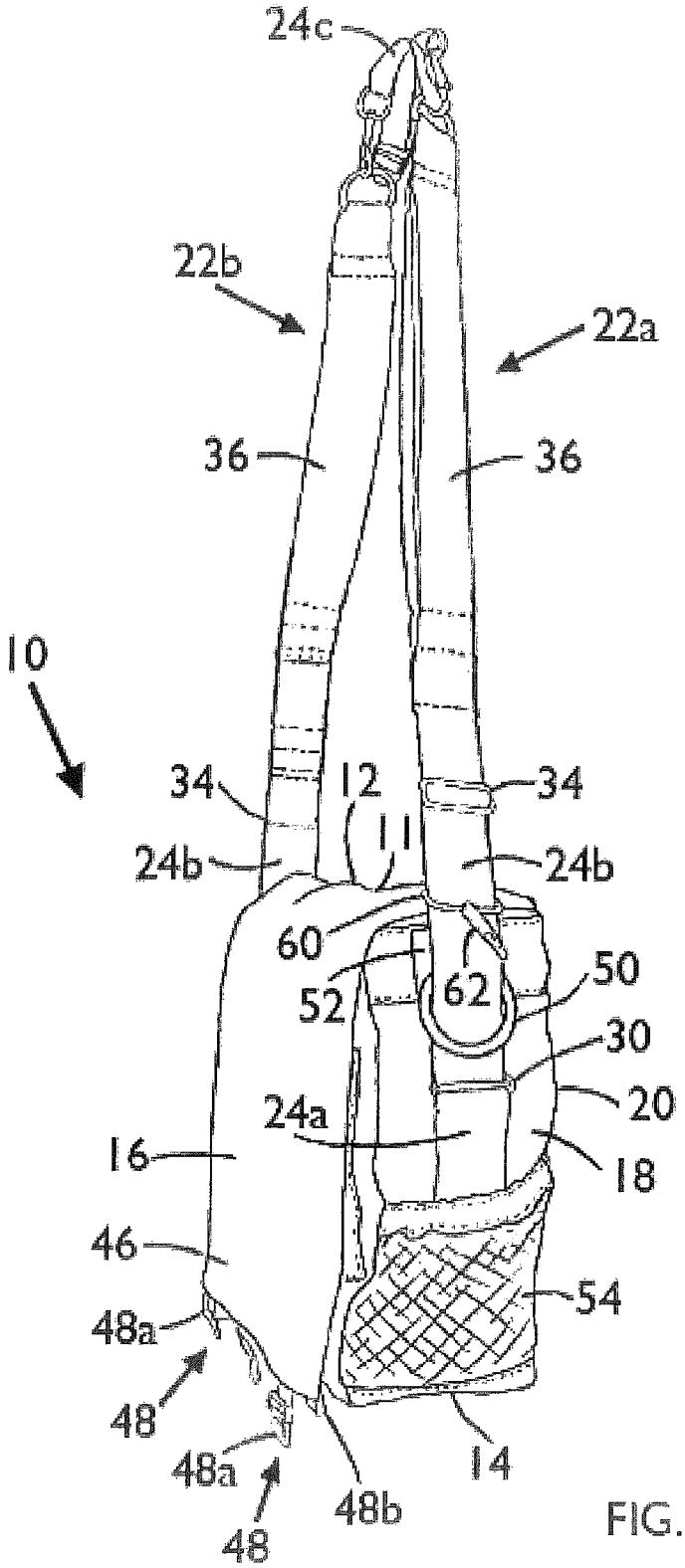
FIG. 11 is a side perspective view of the backpack with the strap arrangement connected as a shoulder bag.
Figure 12:
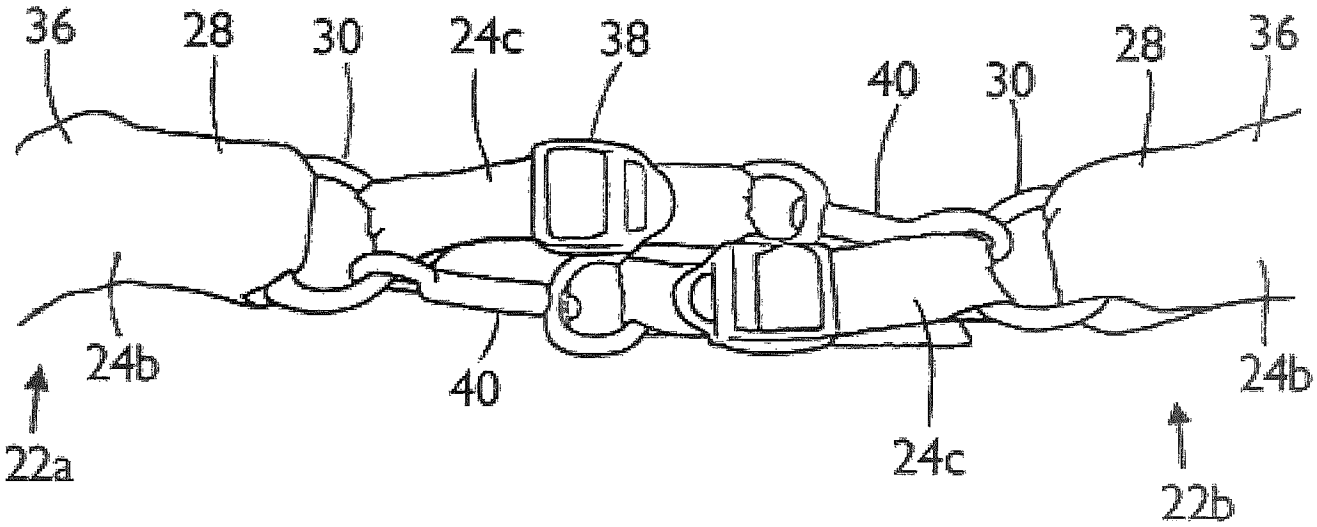
FIG. 12 is an enlarged view of a connection of straps for the configuration of FIG. 11.

Referring to FIGS. 11 and 12, the strap arrangement 22 can be disconnected from the backpack configuration and reconnected together in shoulder bag configuration. To accomplish this, the releasable connectors 62 of the rear strap redirecting members 60 are disconnected from handle 64, and the releasable connectors 40 of strap segments 24*c* are disconnected from strap segments 24*d*. The releasable connectors 40 of each strap segment 24*c* can then be connected with the ring 30 of a strap segment 24*b* in opposite and side by side relation (see FIG. 12).

Figure 13:
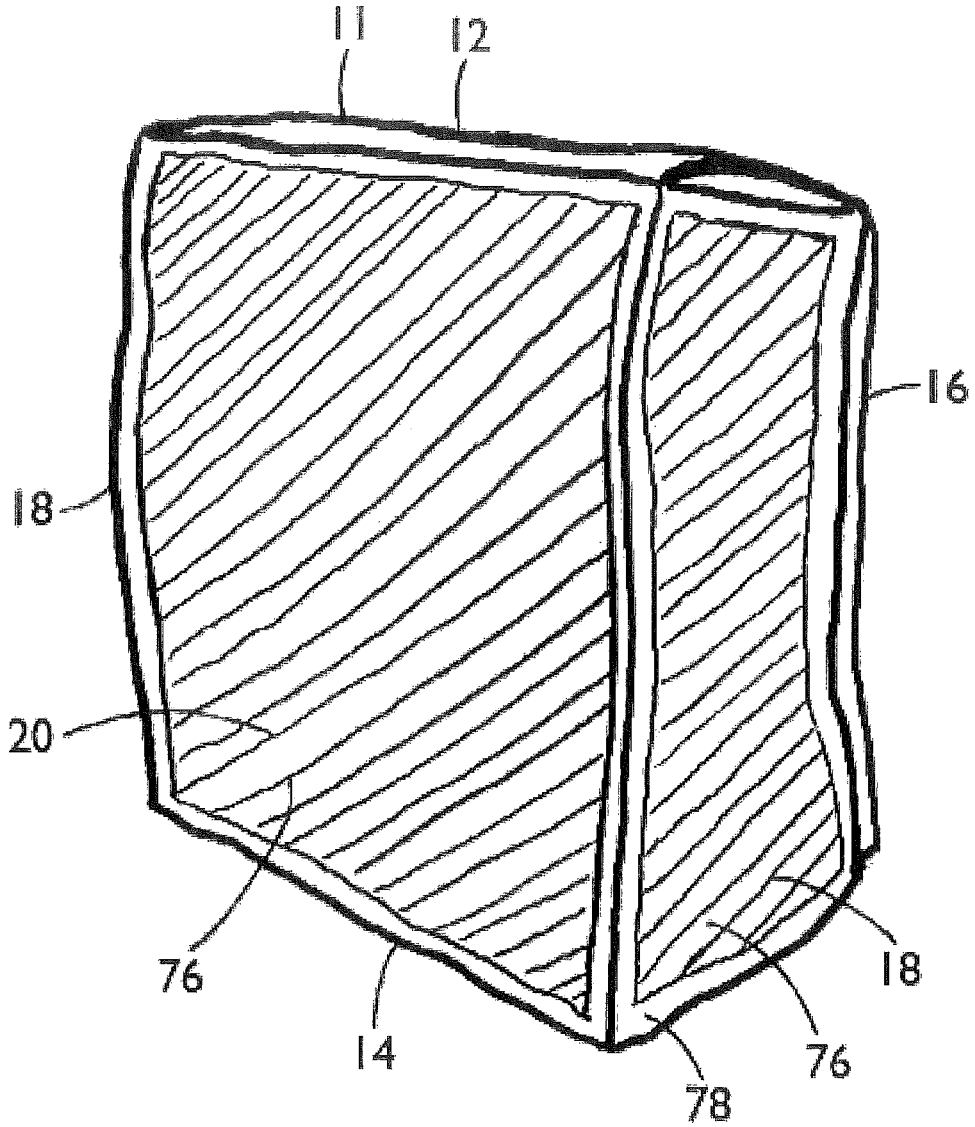
FIG. 13 is a rear perspective schematic view of a pack portion having stiffening members such as foam sewn into the pack portion.

Referring to FIG. 13, the pack portion 11 can in addition to the stiffening member 66, or in replacement of the stiffening member 66, include stiffening members 76 which can be attached to the sidewalls and bottom of the pack portion 11, for example by sewing, positioned in a pocket, or by adhesives. This can form a stiffened structure 78. In some embodiments, the stiffening members 76 can be foam panels or members, to form a soft stiffened structure, or an internal or integral soft frame. In embodiments where an upper horizontal stiffening member 66 is used in combination with foam stiffening members 76, the stiffening member 66 can also support or pull upwardly the bottom 14 via the foam stiffening members 76 of the stiffened structure 78. In other embodiments, more rigid materials can be used, such as plastic, paperboard, composites, metals, etc. In other embodiments, a stiffened structure 78 can be a separate component that is inserted into the pack portion 11 to provide stiffening and can be a foam insert that can be generally the same shape as the pack portion 11. Furthermore, in some embodiments, the pack portion 11 can be partially or entirely rigid and can include rigid shell components.

Figure 5:
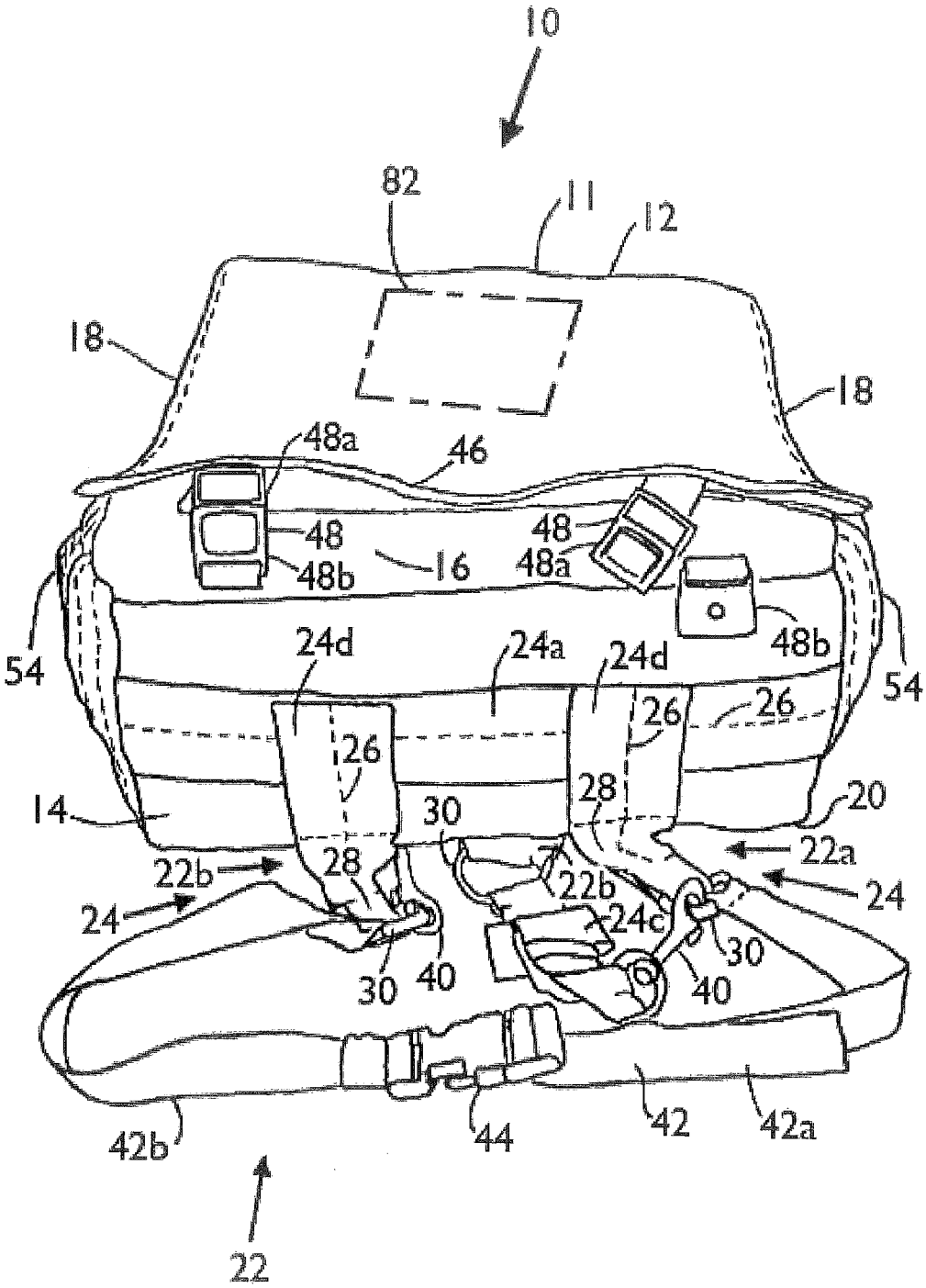
FIG. 5 is a front bottom view of the backpack.
Figure 6:
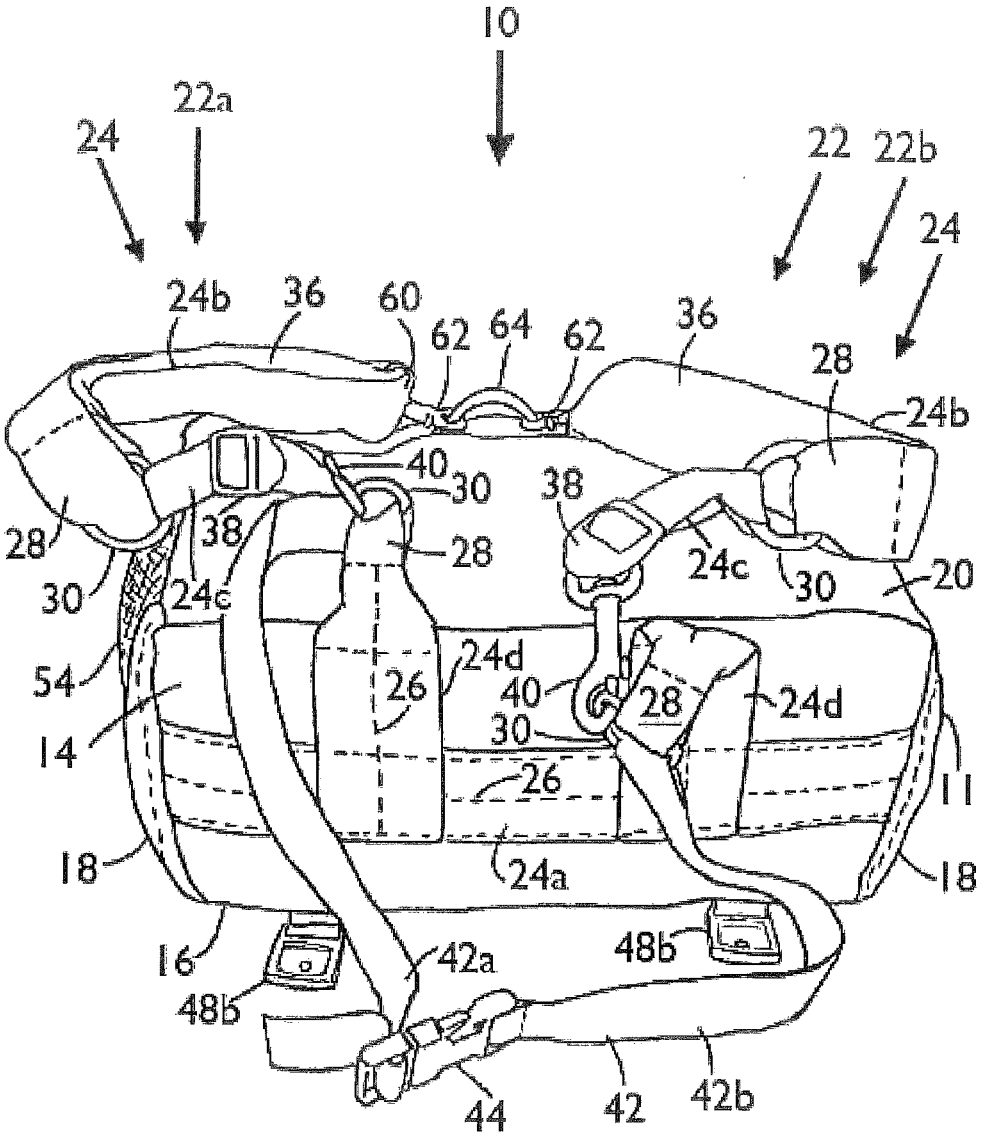
FIG. 6 is a rear bottom view of the backpack.
Figure 7:
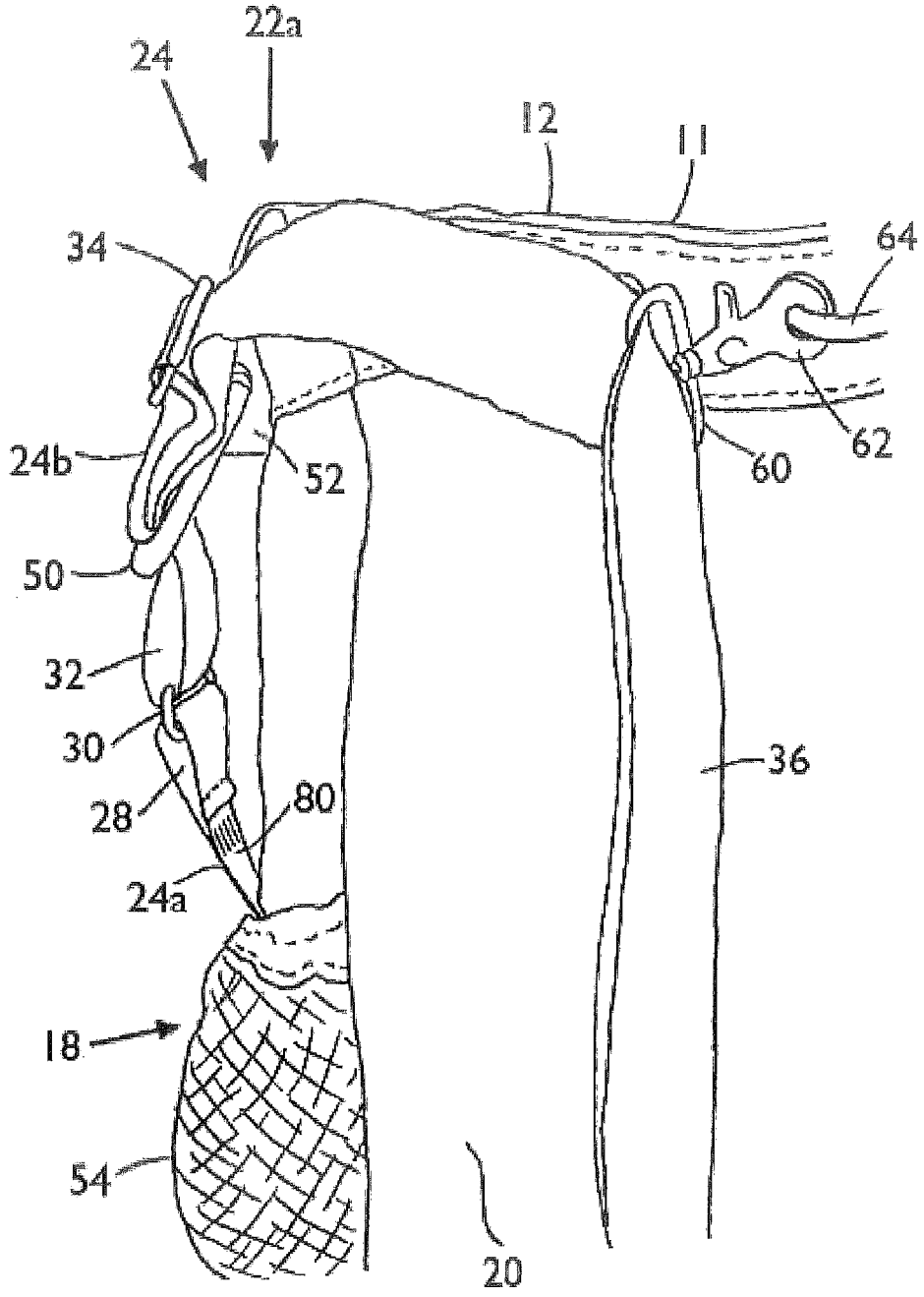
FIG. 7 is an enlarged view of an upper rear portion of the backpack showing the redirection of a carrying strap.

The backpack 10 can include a refrigeration or freezer unit for keeping items cool, which can be electrically powered. The refrigeration unit can include a battery and the straps 24, for example, on the sides 18, can include piezoelectric elements or material 80 (FIG. 7), or can be formed of piezoelectric strap material, for generating electricity, by the rising/falling tension forces encountered during walking. This can operate an electrical device, such as a refrigeration unit, or charge a battery. This can also be used for providing electricity to a computer, such as a laptop computer, when the backpack is used as a book or computer bag. In other embodiments, a heater can be powered. In addition, a solar cell system 82 can be provided on the pack portion 11 for generating electricity, for example on the flap 46 (FIG. 5).

Figure 14:
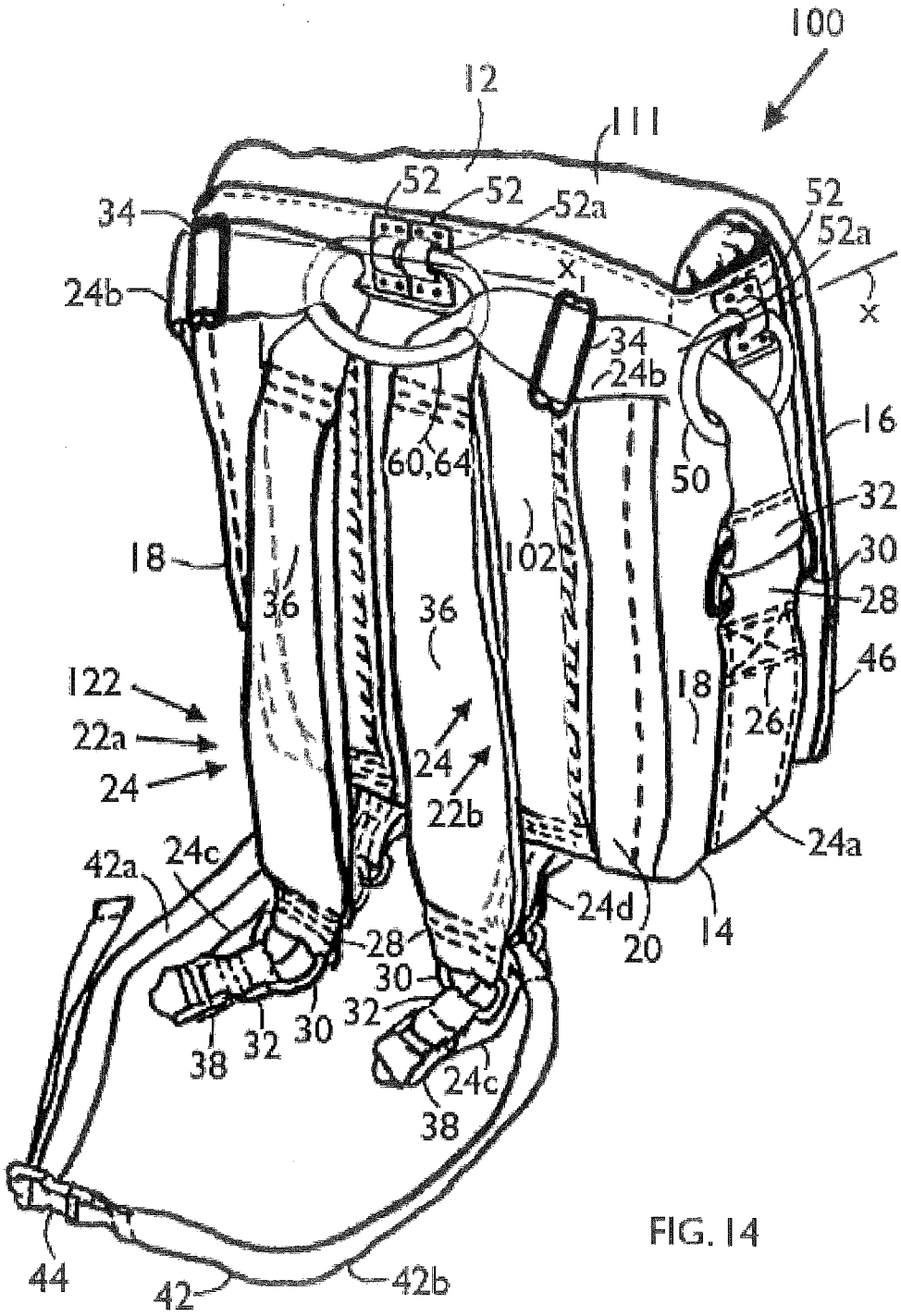
FIG. 14 is a rear perspective view of another embodiment of a backpack in the present invention.
Figure 15:
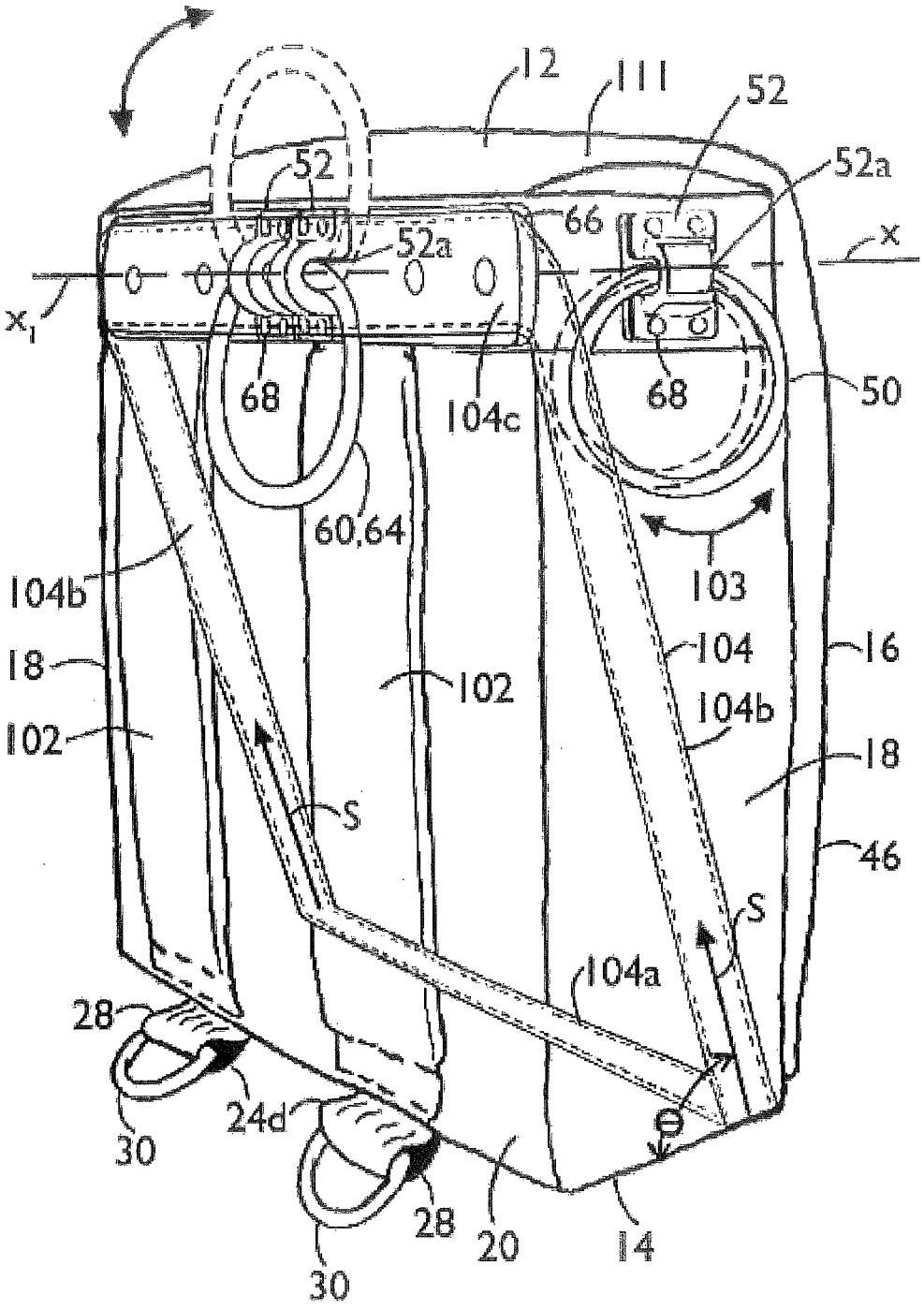
FIG. 15 is a rear perspective schematic drawing of the pack portion of the backpack of FIG. 14, showing a support strap within the pack portion, stiffening member, and strap redirecting ring members.
Figure 16:
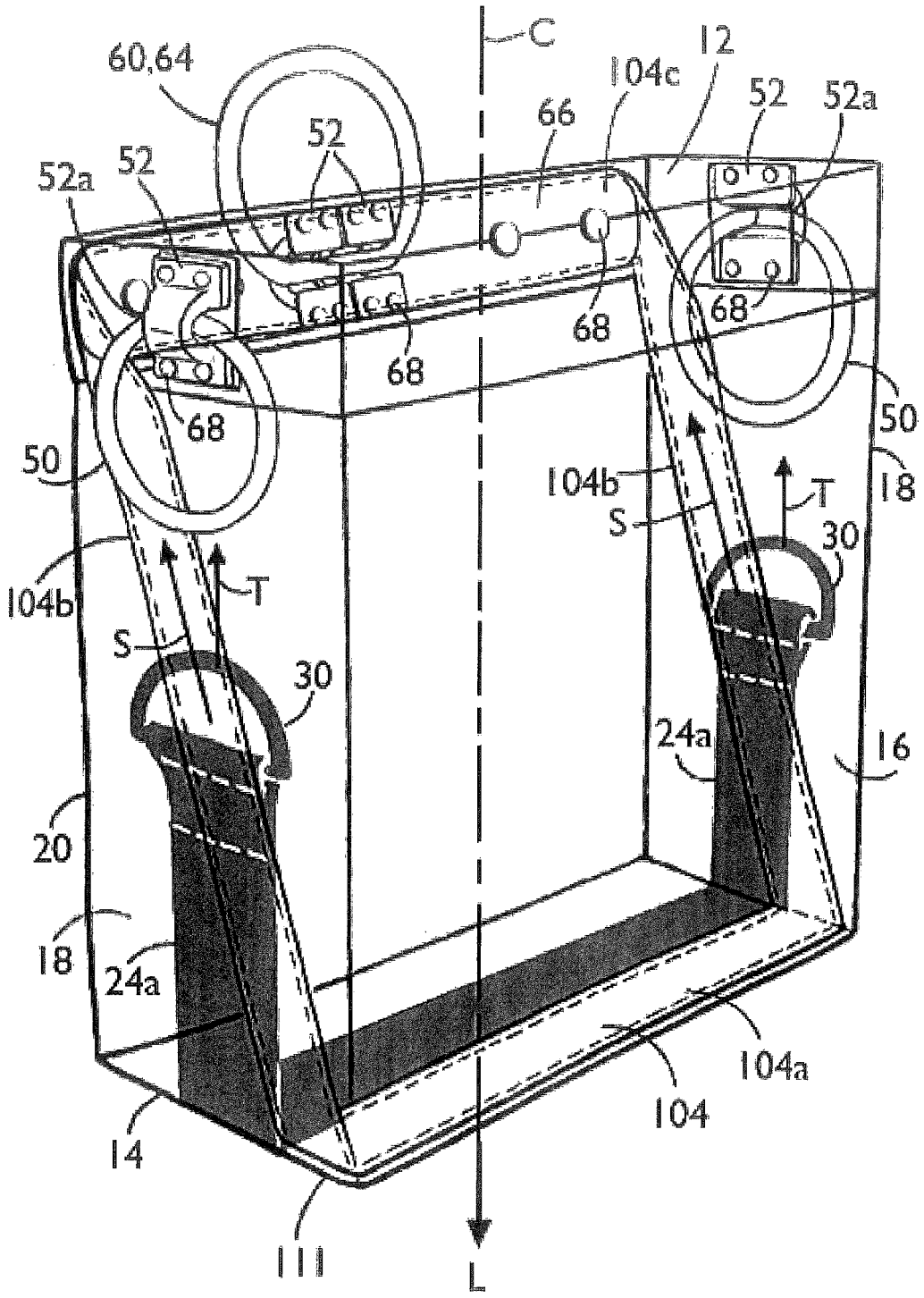
FIG. 16 is a front perspective schematic drawing of the pack portion of FIG. 15 showing the support strap, stiffening member, strap redirecting ring members, and a lower or bottom strap segment.
Figure 17:
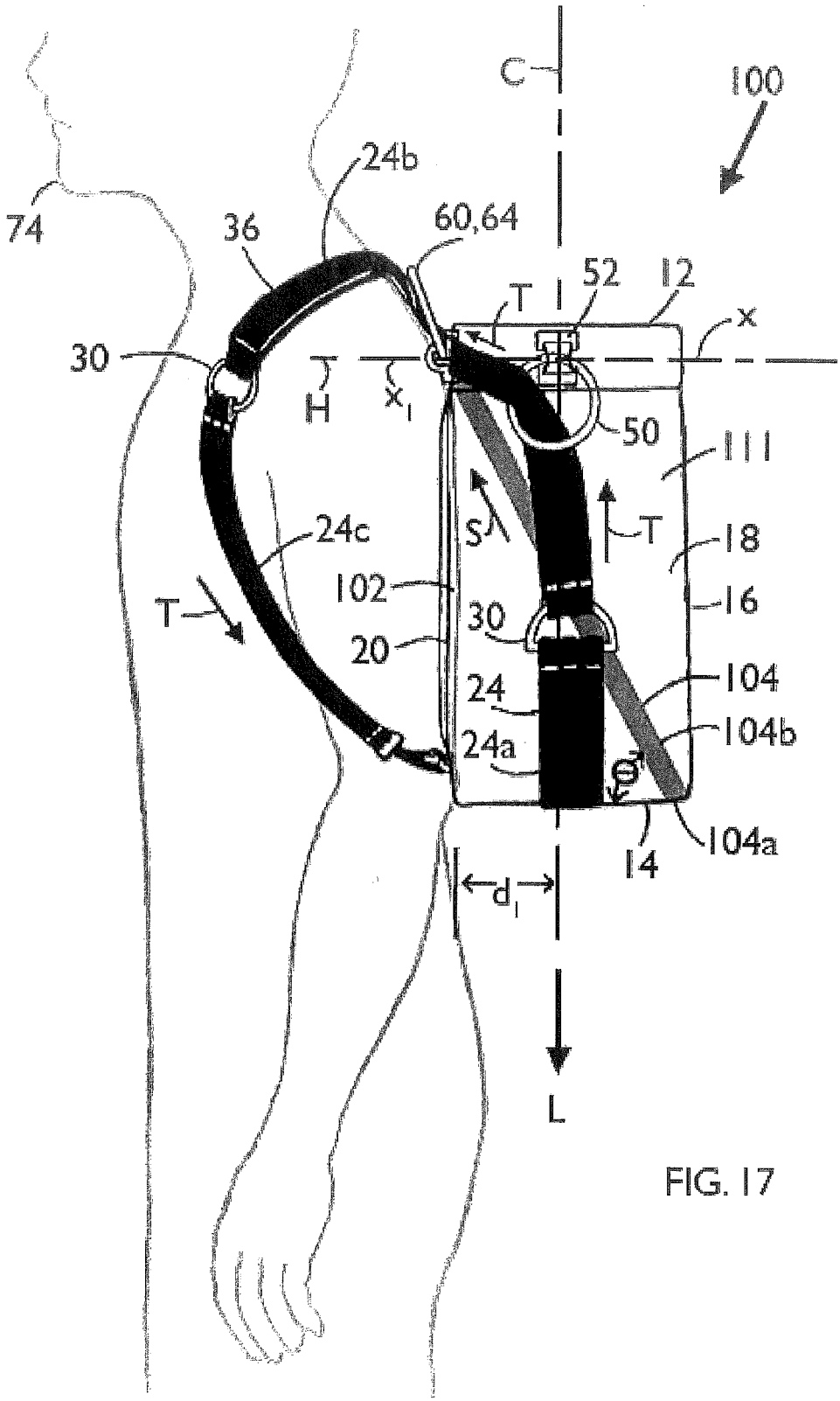
FIG. 17 is a side schematic drawing of the backpack of FIG. 14 worn by a user.

Referring to FIGS. 14-18, backpack 100 is another embodiment in the present invention, and can have a pack portion 111 and a strap arrangement or assembly 122 for carrying the pack portion 111 as a backpack. The strap arrangement 122 is similar to strap arrangement 22 but differs in that the straps 24 of the shoulder straps 22*a* and 22*b* can pass through a rear strap redirecting arrangement having a single rear strap redirecting member 60 that is rotatably mounted to upper regions or at the top of the rear 20 of the pack portion 111 and to stiffening member 66 extending across the rear 20 at upper regions or at the top, about a rotatable axis $X_1$, which can allow the strap redirecting member 60 to pivot or rotate. The strap redirecting member 60 can pivot upwardly into an upper vertically oriented position and downwardly into a lower vertically oriented position in about a 180° vertical range, as seen in FIG. 15, or into an intermediate position as seen in FIG. 17. The strap redirecting member 60 can be a single ring which can generally oval shaped or laterally elongated with curved sides or ends, for positioning or spacing the straps 24 of the shoulder straps 22*a* and 22*b* close to and on opposites sides of the central axis C by distance $d_2$. In some embodiments, the ring can be rectangular in shape. The strap redirecting member 60 can also form a handle 64. The strap redirecting member 60 can be rotatably secured to the stiffening member 66 by at least one mount 52, such as two as shown. In some embodiments, two rear strap redirecting members 60 can be rotatably mounted along axis $X_1$ adjacent to each other by one or two mounts 52. In other embodiments, the straps 24 can pass through a single rigid handle 64 such as seen in FIG. 8, which forms the rear strap redirecting member 60.

The mounts 52 can be similar to those shown in FIGS. 2, 3 and 8, and can be secured to the stiffening member 66 from the exterior of the fabric or material of the rear 20 of the pack portion 111 by fasteners 68. In some embodiments, the mounts 52 can have the appearance, design or construction as shown in FIGS. 14-17, and can be also used for the side strap redirecting members 50. The pivoting or rotating ability of the rear strap redirecting member 60 allows the ring 60 to pivot into a position, such as seen in FIG. 17, to comfortably contact or lie on the back of the user 74 which allows the pack portion 111 to be positioned closely to the user's 74 back, and can sometimes be worn closer than pack portion 11. The side strap redirecting members 50 can pivot about axis X upwardly and downwardly in about a 180° vertical range, and the mounts 52 can also allow some limited rocking side to side, generally in the longitudinal direction of axis X, as shown by arrows 103 in FIG. 15. The rotatable axes $X_1$ and X of strap redirecting members 50 and 60 can be generally at right angles to each other, and can be located generally along a common or the same horizontal plane, level or axis H (FIGS. 17 and 18).

A support member or strap 104 can be secured or mounted to the stiffening member 66 within pack portion 111. The support strap 104 can have a bottom portion 104*a* which can be secured to and extend along the width of the bottom 14 of the pack portion 111, for example, horizontally or laterally, at or near the front junction or edge where the bottom 14 meets or joins with the front 16. Two side portions 104*b* are connected to or extend from opposite ends of bottom portions 104*a* and can extend upwardly at an angle along respective sides 18 at a right angle relative to bottom portion 104*a*. If desired, side portions 104*b* can be secured to the sides 18. The side portions 104*b* can extend upwardly and rearwardly from the front bottom of sides 18 at the junction of the front 16, at an angle θ, to the rear top or upper regions of the sides 18 at the junction of the rear 20. The upper portions of the side portions 104*b* are connected to or extend from opposite ends of an upper portion 104*c* which can extend along and mount against the stiffening member 66 for securement thereto at the rear 20 of the pack portion 111, and across the top or upper regions along the width of the rear 20. The upper portion 104*c* can be sandwiched between the stiffening member 66 and the material of the rear 20 by fasteners 68, but alternatively, can be secured to the opposite side of stiffening member 66. The portions 104*a*, 104*b* and 104*c* can be integrally connected together, or can be formed from two or more pieces attached to each other. The support strap 104 can be formed of a narrow strip of webbing material or fabric, plastic, metal, or other suitable materials, and can be generally formed or connected into a generally rectangular hoop or loop. The bottom portion 104*a* can help support the bottom 14 of the pack portion 111 when subjected to load L from contents contained therein. The side portions 104*b* can transmit a share of the load L supported by bottom portion 104*a*, each with a support tension S, that angles upwardly to the opposite ends of stiffening member 66 at the top or the rear 20, and is transferred to and supported by stiffening member 66, which is transferred onto the user 74 via straps 24 passing through rear strap redirecting member 60. As seen in FIG. 16, this can supplement the load L that is supported and transferred by the strap segment 24*a* and the straps 24, and can help the backpack 100 more comfortably and better carry the weight of items therein. The strap segment 24*a* can support and transfer weight centered along the central axis C, and the support strap 104 can support and transfer weight acting or located beyond the central axis C near the front 16 of the pack portion 111. The support strap 104 can be employed instead of having a stiffened structure 78 or foam insert (FIG. 13), or can be used in conjunction with a stiffened structure 78. In some embodiments, the support strap 104 and/or stiffening member 66 and/or redirecting members 50 and 60, can be part of the strap arrangement 122, and in other embodiments, part of the pack portion 111.

Figure 18:
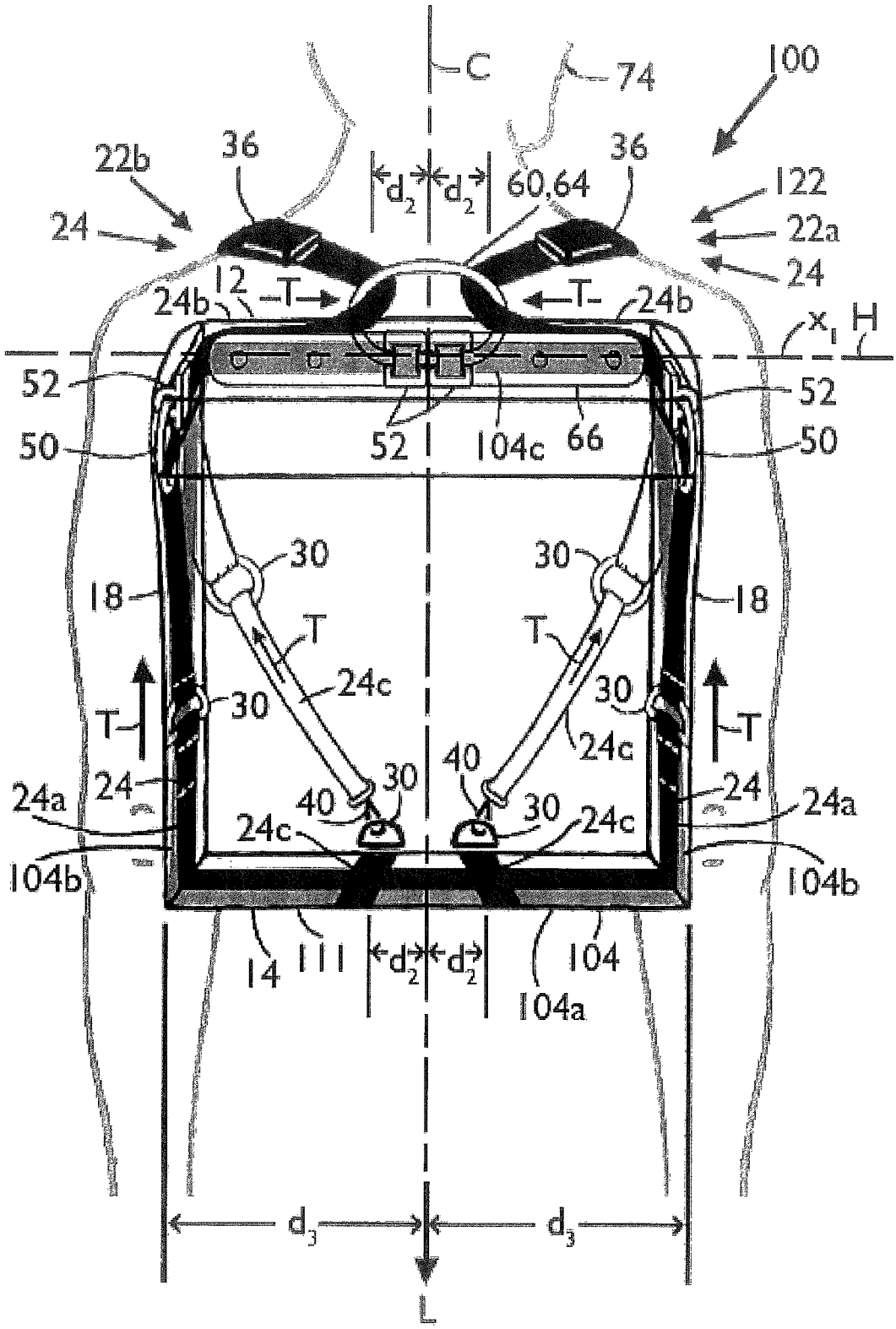
FIG. 18 is a rear schematic drawing of the backpack of FIG. 14 worn by a user.

Referring to FIGS. 17 and 18, as described above, the support strap 104 can support and transfer weight that is acting or located beyond the central axis C on the side away from the user 74, via support tension S up the side portions 104*b* to the stiffening member 66 at the rear of the pack portion 111 and against the back of the user 74. The straps 24 of the shoulder straps 22*a* and 22*b* of strap arrangement 122 carry and transfer the load L in a similar manner to that previously described above and shown in FIGS. 9 and 10. With the rear strap redirecting member 60 being pivotable about axis $X_1$, the rear strap directing member 60 can be positioned or pivoted upwardly about axis $X_1$ while the side strap redirecting members 50 can be positioned or pivoted downwardly about axis X as shown. As the straps 24 movably or slidably pass through the side strap redirecting members 50 and are movably or slidably redirected from travelling in an upwardly vertical direction to a generally lateral or horizontal direction relative to sides 18, the straps 24 can have a slight incline upward (FIG. 17) while extending away from strap redirecting members 50 to movably or slidably pass through strap redirecting member 60, but can still be considered being redirected along a generally or substantially lateral or horizontal direction. As also seen in FIG. 17, the straps 24 can be directed by strap redirecting member 60 slightly laterally or horizontally forwardly to pass or fit over the user's 74 shoulders before extending downwardly for securement to the bottom 14 of the pack portion 111, but can still be considered being redirected to extend generally or substantially in a downward vertical direction. In addition, depending upon the distance $d_2$ between the straps 24 passing through the rear strap redirecting member 60 and the central axis C, the distance $d_2$ between the straps 24 and axis C at the securement location at about the bottom 14 of the pack portion 111 at the rear 20, and the size of the user 74, the portion of the straps 24 that is movably or slidably redirected by the rear strap redirecting member 60 into a generally downward vertical direction can have a slight angle, bend or curve, relative to central axis C or vertical, in order to conform to and fit around the user's 74 body, but can still be considered being redirected into a generally or substantially downward vertical direction.

The strap adjusters 34 on the strap segments 24*b* of straps 24 (FIG. 14) can be adjusting or slide rings or members, which can adjust the length of straps 24 to fit the top part of the user's 74 body closely, which can increase comfort, such as when the user 74 is leaning forward. This can also make the shoulder straps 24 less susceptible from coming off the user 74 due to closely wrapping around the shoulders from behind the back of the neck, to the front or chest of the user 74, and around to the bottom of the pack portion 111. The strap adjusters 34 can be positioned between the rear strap redirecting member 60 and the side strap redirecting members 50, which can be circular "o" rings. In some embodiments, the strap adjusters 34 can have rounded shapes to optimize the ability for straps 24 to redirect the direction of travel around the pack portion 111.

Referring back to FIGS. 14, 15 and 17, the pack portion 111 can differ from pack portion 11 in that the rear 20 of the pack portion 111 can have two pads or padded portions, segments or areas 102, which can extend generally vertically in a spaced apart manner for providing padded comfort against the back of the user 74. Additionally, as seen in FIG. 14, pockets 54 can be omitted from the sides 18.

Figure 19:
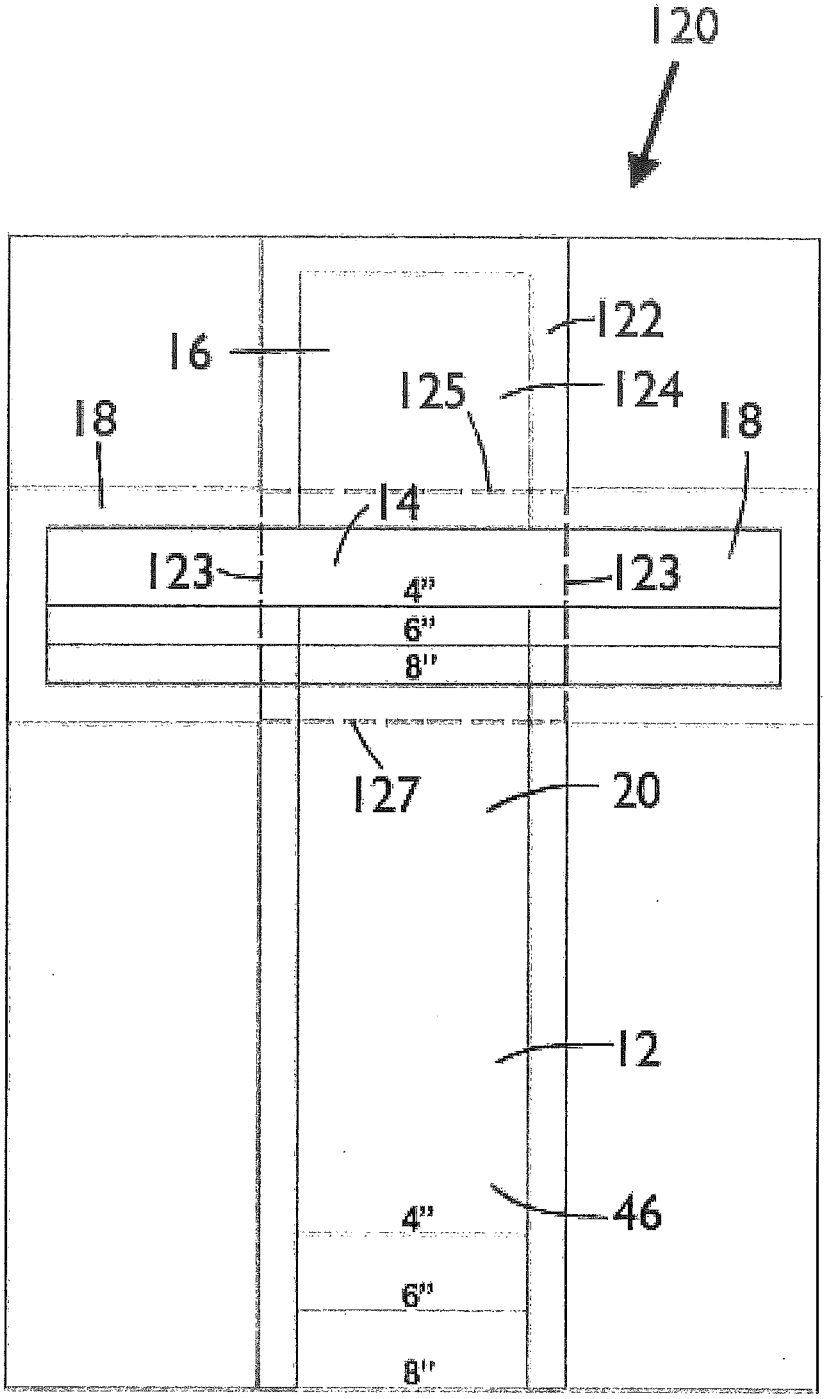
FIG. 19 is a drawing of an embodiment of a pattern of material for a pack portion in the present invention.
Figure 20:
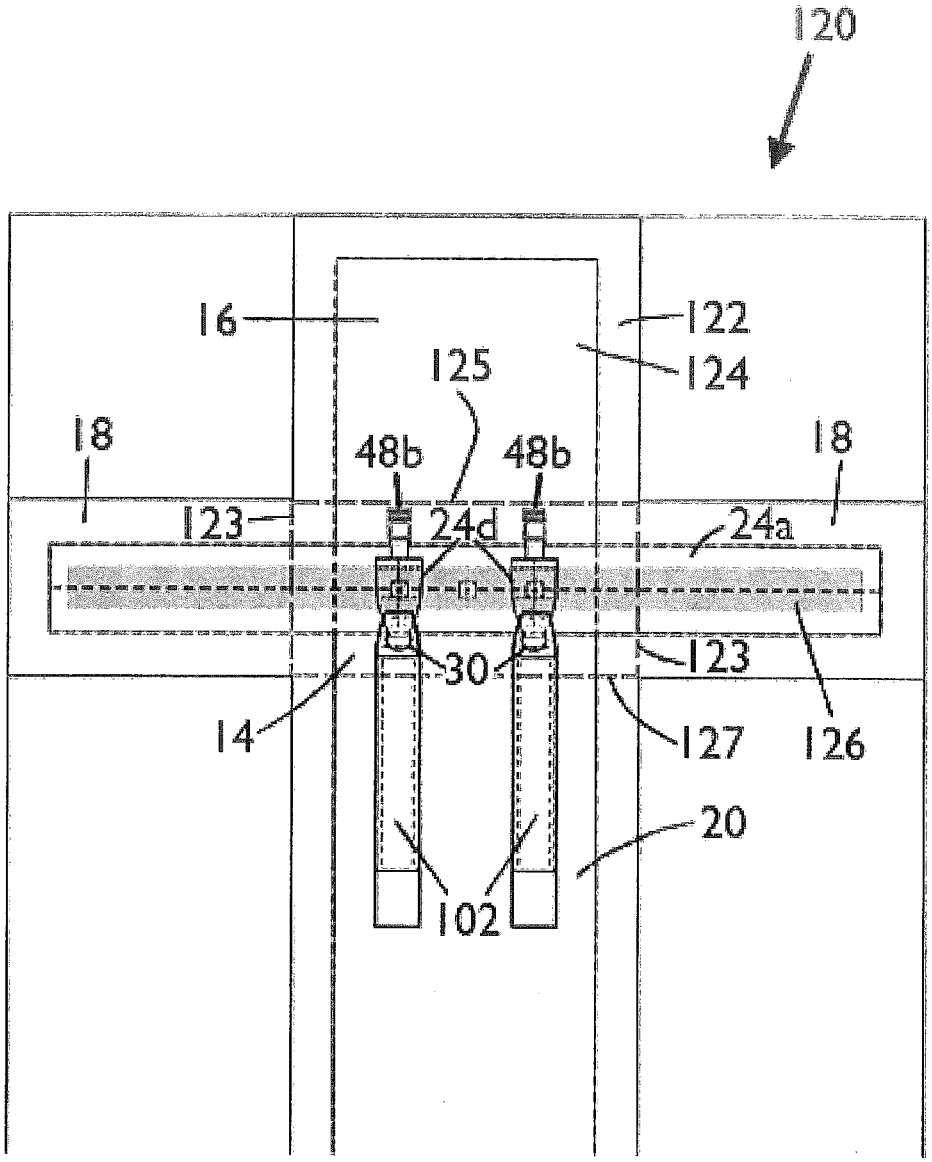
FIG. 20 is a drawing of a portion of the pattern of FIG. 19 with some strap segments and elements attached.

Referring to FIGS. 19 and 20, the pack portion 111 of back pack 100 can be formed or constructed, by cutting material from a pattern 120. Fashion fabric or material, and lining fabric or material can be laid on top of each other, fabrics 122 and 124, in an order as desired, and cut into the configuration shown, such as in a cross configuration. One cross can be larger than the other, or the two crosses can be the same size. FIG. 19 shows different relative sizes of the pattern 120 which can be used for different sized pack portions 111, for example for 4", 6" and 8" depth pack portions 111. The pattern 120 can have a rectangular central panel for the bottom 14 of the pack portion 111, two rectangular side panels foldably connected to opposite sides or side edges of the central panel along fold lines 123 for the sides 18, a rectangular first or top panel foldably connected to the first or top edge of the central panel along fold line 125 for forming the front 16, and an elongated rectangular second or bottom panel foldably connected to the second or bottom edge of the central panel along fold line 127 for forming the rear 20, top 12 and flap 46. This configuration can accommodate energy harnessing wiring prior to sewing up the pack portion 111. Openings within the fashion material, the lining material, or the spaces therebetween, can be provided to attach or include electronics and/or electrical wiring. The electronics and/or electrical wiring can be installed within the openings or between the layers before assembly. In some embodiments, the electronics and/or wiring can be installed within removable panels. Access to the electronics and/or electrical wiring provided by such openings, spaces or removable panels can facilitate assembly and repair. Referring to FIG. 20, strap segment 24*a* can be secured or sewn across the bottom 14 and a lower portion of sides 18 as shown. If desired, an energy harnessing member 126 can be attached, or can be part of strap segment 24*a*. Padded portions 102 can be formed on the rear 20, and strap segments 24*d* and portions 48*b* of clips 48 can be secured or sewn to the bottom 14. The strap redirecting members 50 and 60, the stiffening member 66 and the support strap 104 can be installed or secured after the panels of the pack portion 111 are sewn or secured together. Pack portion 11 can also be formed from a similar pattern.

Figure 21:
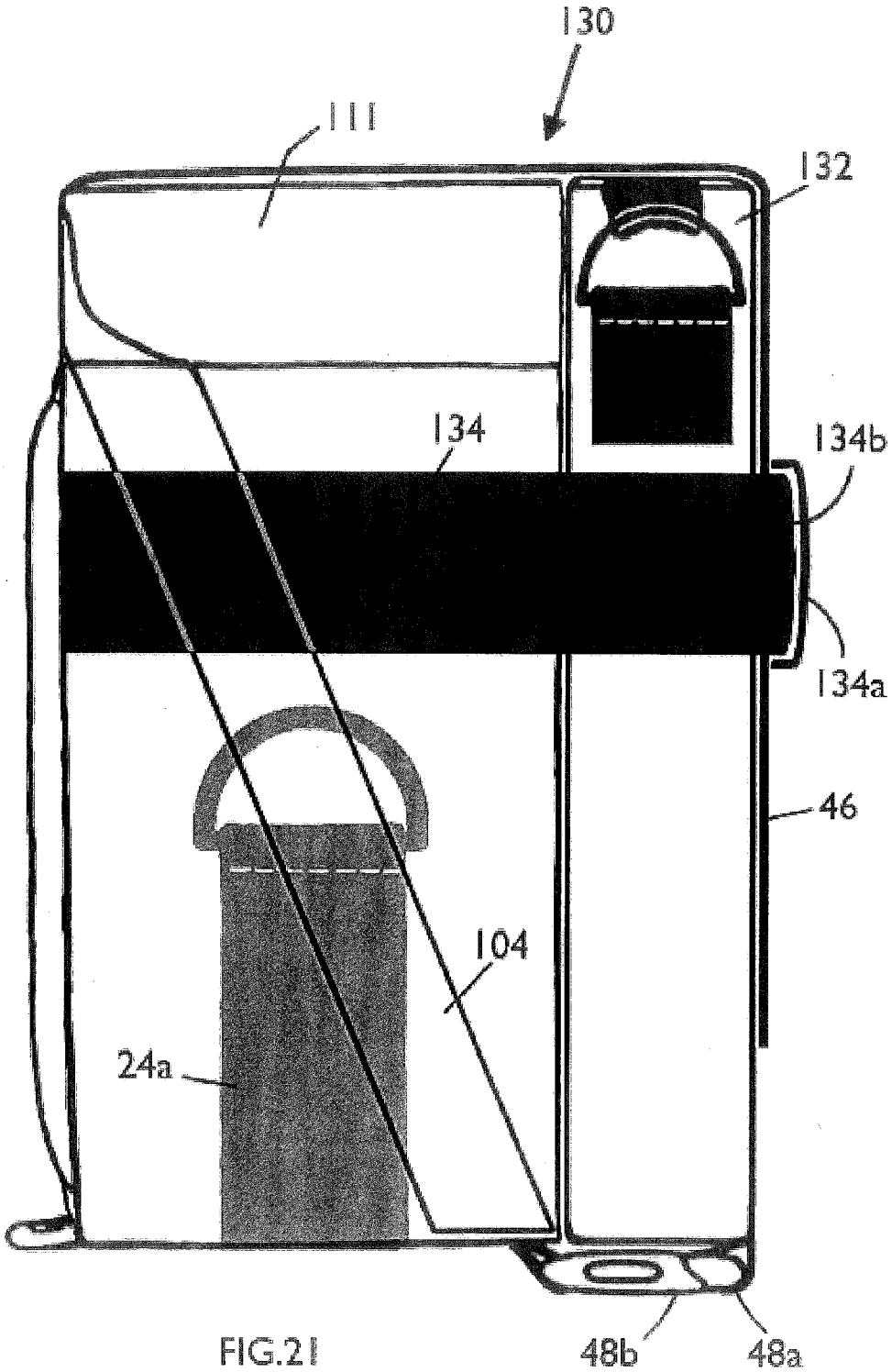
FIG. 21 is a side schematic view of another embodiment of a backpack in the present invention, having a removable bag.
Figure 22:
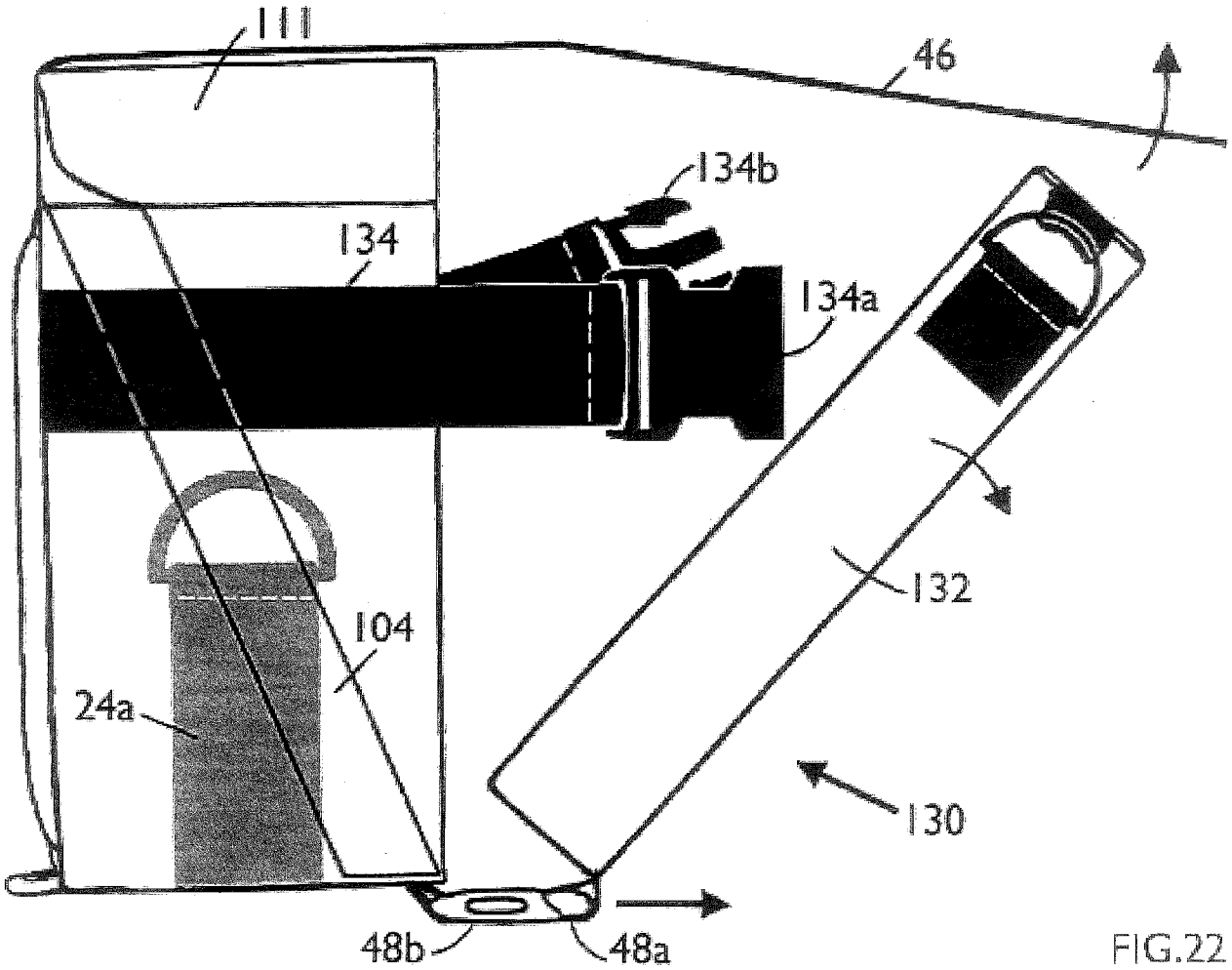
FIG. 22 is a side schematic view of the back pack of FIG. 21 showing removal of the removable bag.
Figure 23:
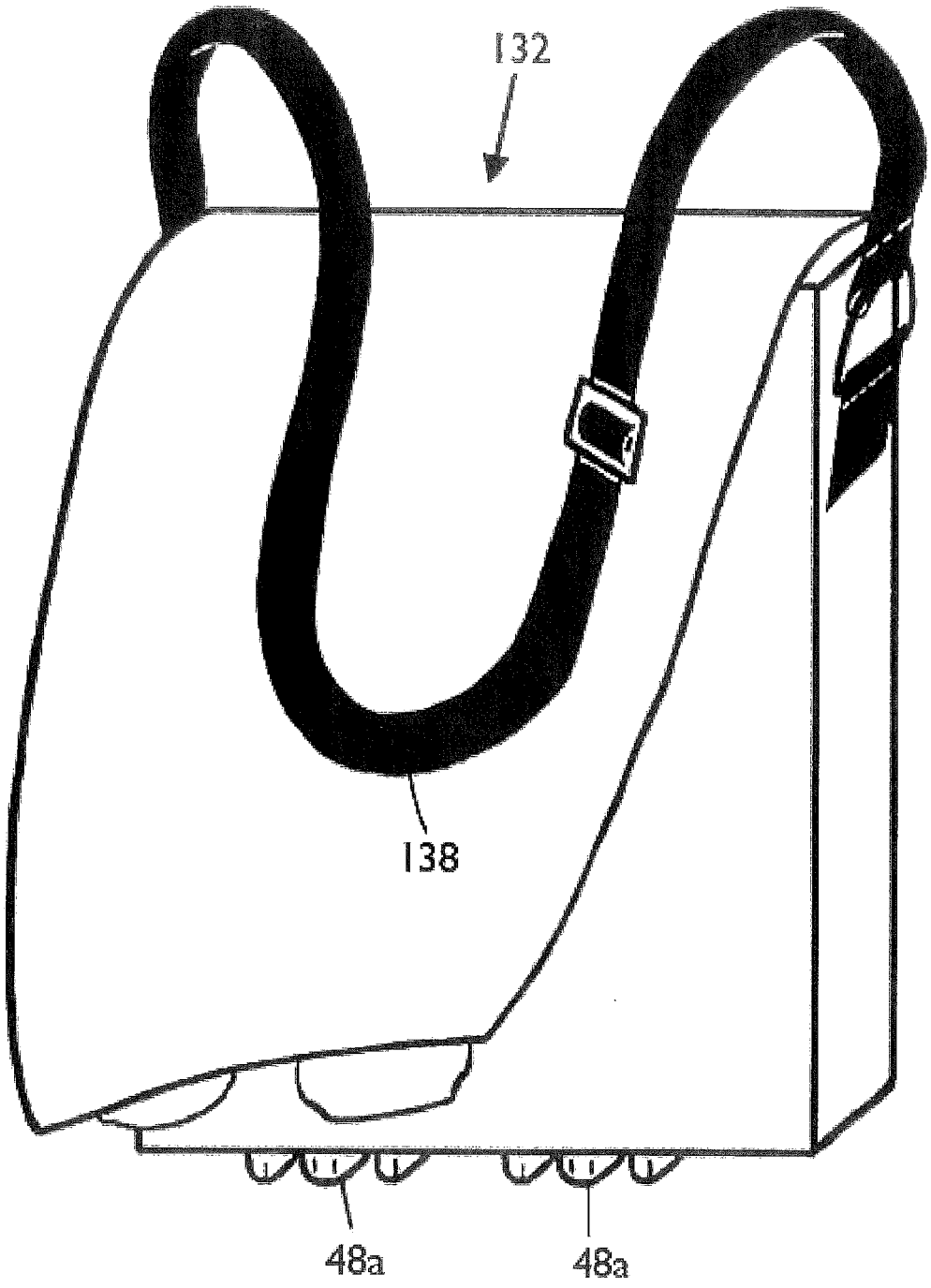
FIG. 23 is a front perspective view of the removable bag seen in FIG. 21.

Referring to FIGS. 21-23, pack portion 111 can be removably attached to a removable shoulder bag 132 to form a combination pack portion or assembly 130. The shoulder bag 132 can have the same width and height as pack portion 111 and can have clip portions 48*a* at the bottom for engaging clip portions 48*b* at the bottom of pack portion 111 for securing the lower portions of shoulder bag 132 and pack portion 111 together. The flap 46 of pack portion 111 can extend or wrap over the top and front of shoulder bag 132. The upper portion of pack portion 111 can have a securement strap 134 with releasable clip portions 134*a* and 134*b* for wrapping around the sides of pack portion 111 and shoulder bag 132, and the front of bag 132 for securing the upper portions of the pack portion 111 and shoulder bag 132 together. Referring to FIG. 22, in order to remove the shoulder bag 132, the clip portions 134*a* and 134*b* are disengaged from each other, flap 46 is lifted, and clip portion 48*a* is separated from clip portion 48*b*. Referring to FIG. 23, once separated, bag 132 can be worn on the shoulder using shoulder strap 138.

Figure 24:
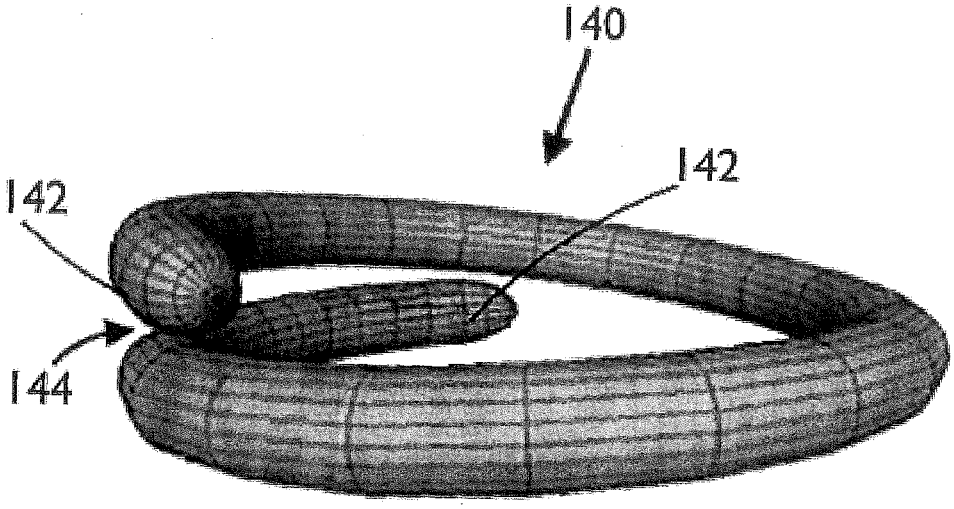
FIG. 24 is a side view of another embodiment of a strap redirecting ring member in the present invention.

Referring to FIG. 24, strap redirecting member or ring 140 is another embodiment of a ring that can be used for strap redirecting members 50 and 60. The ring 140 can have ends 142 which overlap each other for some distance, forming an openable passage 144 therebetween, to allow straps 24 to be inserted therethrough for slidable containment therein. In some embodiments, ring 140 can be 2 inches in diameter, and can be elongated for strap redirecting member 60 if desired. Strap redirecting member 140 can be formed of metal, such as steel or aluminum, or can be plastic or composites, including carbon fiber. Strap redirecting members 50 and 60 can also be made of these materials.

Figure 25:
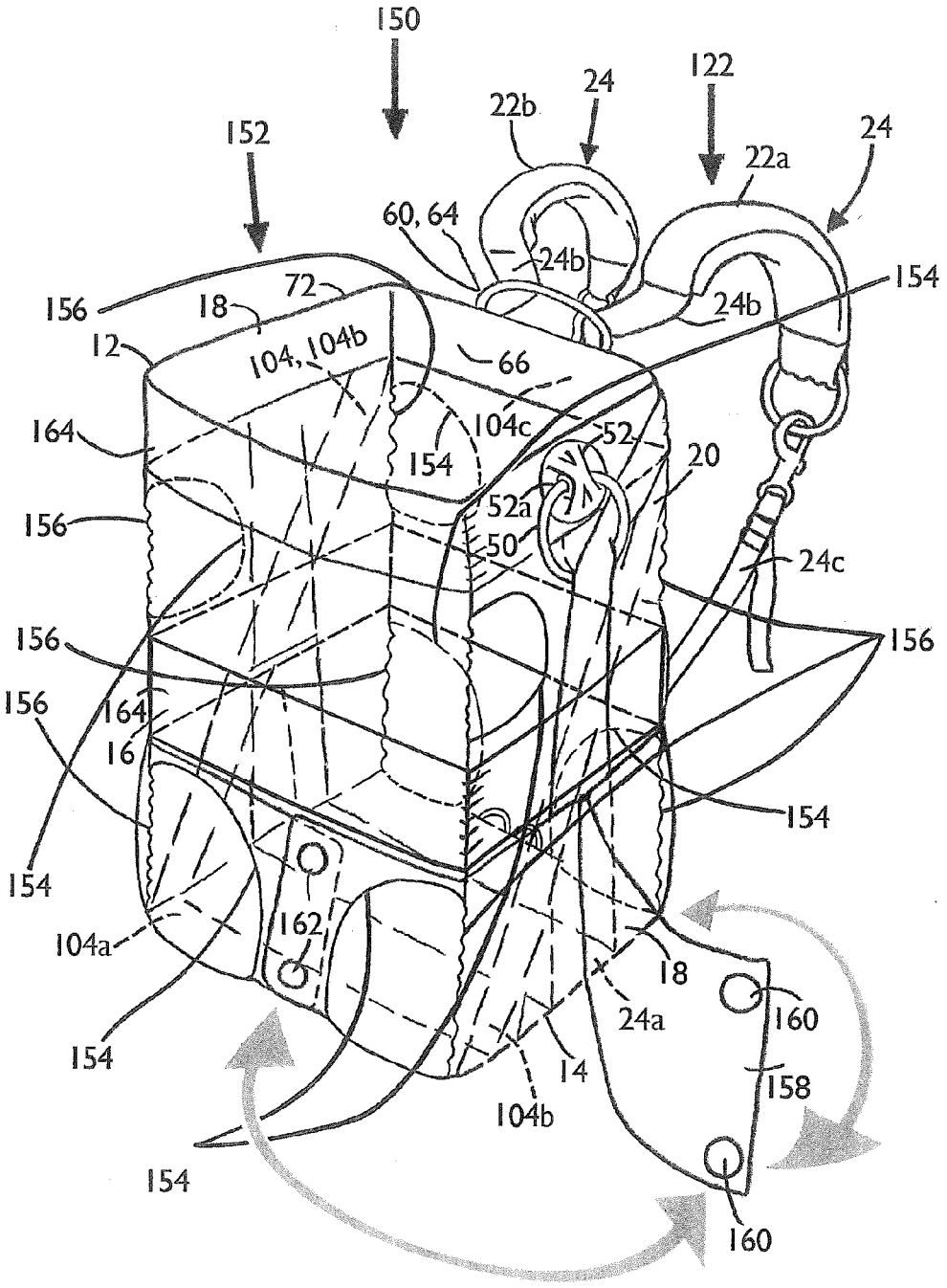
FIG. 25 is a perspective schematic drawing of another embodiment of a carrying pack in the present invention.

Referring to FIG. 25, carrying pack 150 is an embodiment of a carrying pack in the present invention which can be used as a backpack, a front pack or forward facing pack, and/or a child carrier. Carrying pack 150 can include a strap arrangement 122 similar to that in backpack 100, and can include among other things, straps 24, redirecting members 50 and 60, stiffening member 66, piezoelectric material 80, and support strap 104, secured to a pack portion 152. Straps 24 can have a construction similar to that described in strap arrangements 22 and 122, and can include strap segments that can be similar or can vary from strap arrangements 22 and 122 as desired. Some embodiments of the rear strap redirecting member 60 can include two rings. Construction and operation for redirecting forces for supporting a load within the pack portion 152 can be similar to that previously described for pack portions 11 and 111, and strap arrangements 22 and 122.

The pack portion 152 can have a construction and dimensions that are suitable for carrying a child, and the top 12 can be open. The pack portion 152 can be formed of flexible fabric. In some embodiments, desired portions can include stiffening members 164, or stiff materials to retain desired shapes, such as extending around the perimeter of the top 12, the midsection and/or at the bottom 14. The sides 18, front 16, and/or rear 20 of the pack portion 152 can include pairs of holes or openings 154 at upper regions at or near the front 16 and/or the rear 20, for allowing a child's arms to extend through. Pairs of holes or openings 154 can also be included at lower regions of the sides 18, front 16 and/or the rear 20 for allowing a child's legs to extend through. This can allow a child to be positioned either in a forward or rearward facing orientation, when the carrying pack 150 is used as a backpack or a front pack. Elastic material 156 can be included around at least a portion of the openings 154 for providing increased fit and/or comfort. Flaps 158 can be included for covering desired openings 154, or allow for other uses, and can have securement members 160 for engaging mating securement members 162 on the pack portion 152 for securing in place. Securement members 160 and 162 can be any suitable securement member, and can include snaps, magnets, hook and loop fastener, buttons, etc. Some embodiments of carrying pack 150 can have openings 154 omitted, and can be used for carrying other loads. If desired, a flap 46 can be used to cover the top 12. As can be seen, the pack portions 11, 111 and 152 can have varying dimensions, depending upon the application at hand. For example, the opening 72 shown in FIG. 25 for pack portion 152 can have a generally square or squarish, or close to square shape, compared to the opening 72 shown in FIG. 8 for pack portion 11, which can be a generally elongate rectangular shape. The terms top 12, bottom 14, sides 18, front 16 and rear 20 have been used to describe the pack portions, and it is understood that this does not limit the orientation or use of the pack portions.

Figure 26:
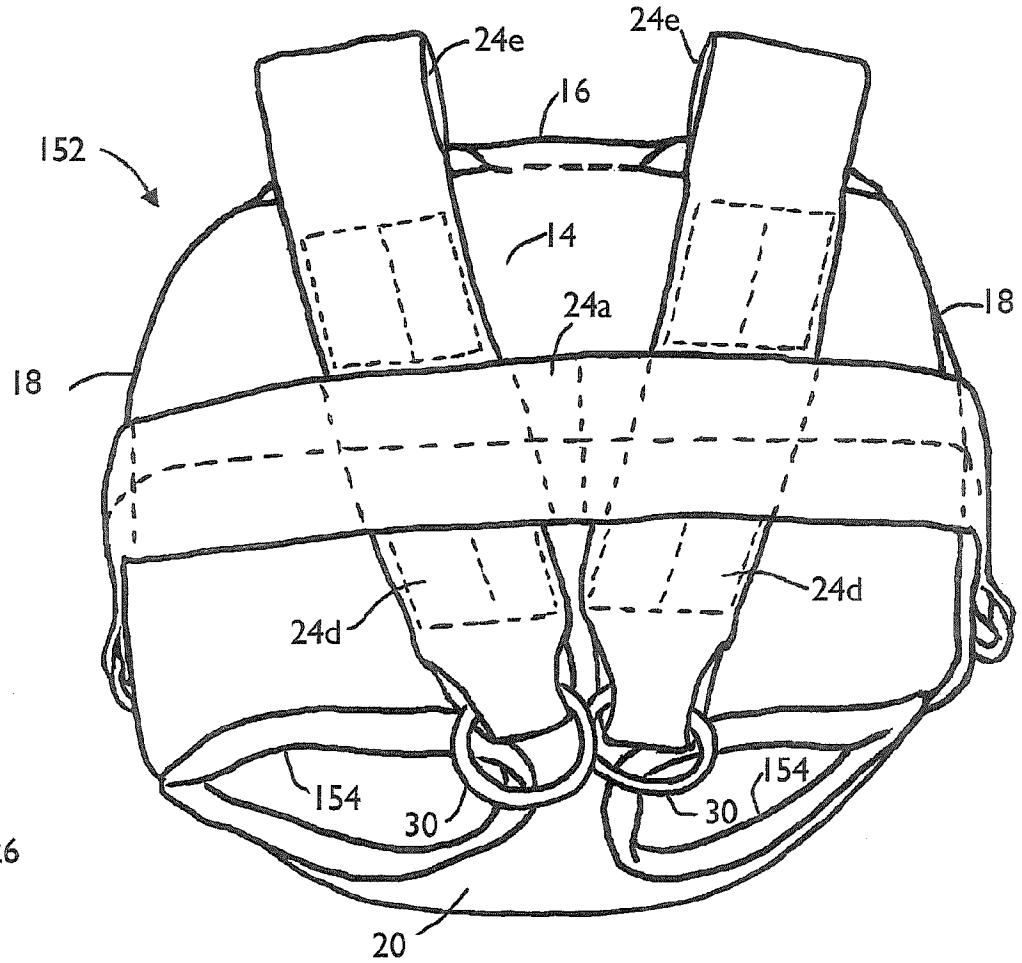
FIG. 26 is a bottom view of an embodiment of the carrying pack of FIG. 25.

Referring to FIG. 26, in some embodiments, the strap segments 24*d* on the bottom 14 of the pack portion 152 can be angled in a vee configuration towards each other and towards the rear 20, such that the strap segments 24*d* are centered and rings 30 are positioned generally or mostly between two leg openings 154 for avoiding the legs of the child. The strap segments 24*d* can each also have loops 24*e* extending at the front 16 of the pack portion 152, which can allow the user to insert hands or fingers to aid support of the child's legs and/or bottom within the pack portion 152. The angle or vee configuration of the strap segments 24*d* can position the rings 30 closer together on opposite sides of axis C than in pack portions 11 and 111, but operation can still be similar. In other embodiments, the strap segments 24*d* can be parallel to each other while being centered and generally or mostly between the two leg openings 154.

Figure 27:
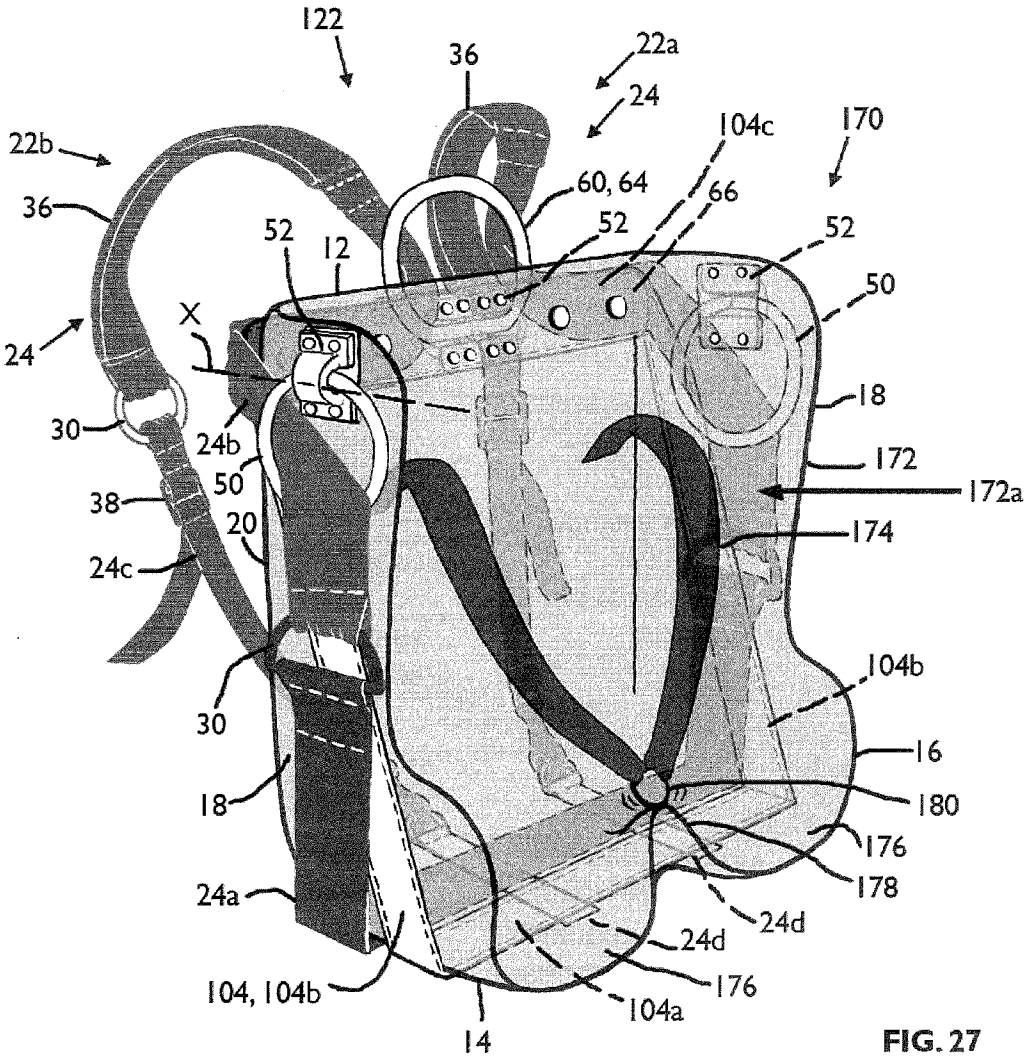
FIG. 27 is a perspective schematic drawing of yet another embodiment of a carrying pack or apparatus in the present invention.

Referring to FIG. 27, carrying pack or apparatus 170 is another embodiment in the present invention which can be used as a child carrier, as a front pack or a backpack. Carrying apparatus 170 can include a strap arrangement 122 that is similar to that in backpack 100 and/or carrying pack 150, and can include among other things, straps 24, redirecting members 50 and 60, stiffening member 66, and support strap 104, that are secured to a carrying pack portion such as a child carrier seat 172. The child carrier seat 172 can be formed or molded of rigid or semi-rigid material, such as plastic, or composites including carbon fiber and fiberglass. Straps 24 can have a construction similar to that described in strap arrangements 22 and 122, and can include strap segments that can be similar or vary as desired. Some embodiments of rear strap directing member 60 can include two rings. Construction and operation for redirecting forces for supporting a load within the carrying portion 172 can be similar to that previously described, including for pack portions 11, 111 and 152, and strap arrangements 22 and 122.

The carrying portion or child carrier seat 172 can be molded to conform to the shape of a child with shaped seat or leg portions 176 for the child's legs, and include restraining straps 174 with a latch 180, that can secure to a raised portion 178 between seat portions 176. The seat 172 can have a rear 20, a bottom 14 and two sides 18, integrally connected together. The top 12 can be at the upper edges of the rear 20 and sides 18, and the front 16 can be at the forward edges of the sides 18 and bottom 14, with the remainder being open on the top and front to allow a child to be positioned in and removed from the interior 172*a* of the seat 172. A stiffening member 66 can be secured to the rear 20 near or at the top 12, and the rear strap redirecting member 60 can be rotatably or pivotably secured thereto and/or the top 12. A side strap redirecting member 50 can be rotatably or pivotably mounted to each side 18 at or near the top 12. Strap segments 24*a* and 24*d* can be secured to or extend across the bottom 14 in a manner similar to backpacks 10 and 100 and carrying pack 150, as shown. An angled support member or strap 104 can be secured, mounted or extended across stiffening member 66, as well as the rear 20, sides 18 and bottom 14 in a manner similar to that shown in FIGS. 15-18, 21, 22 and 25, as seen. Support strap 104 can operate in a manner similar to that described above.

Figure 28:
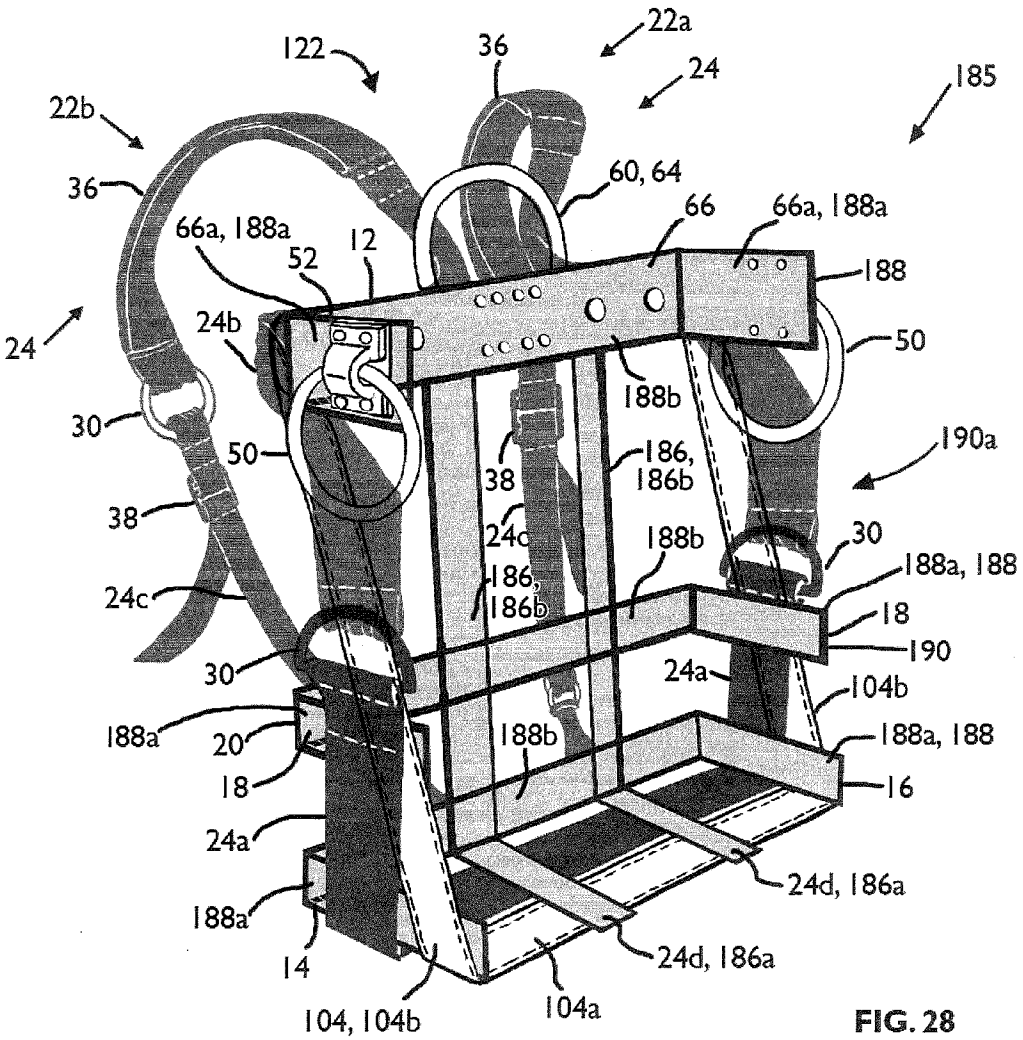
FIG. 28 is a perspective view of still another embodiment of a carrying pack or apparatus in the present invention.

Referring to FIG. 28, carrying pack or apparatus 185 is another embodiment in the present invention which can be useful for carrying articles or items, including containers, tanks, fire extinguishers, etc., as a front pack or backpack. The carrying apparatus 185 can include a strap arrangement 122 that is similar to that used for carrying apparatus 170, and can include a support member or strap 104. The carrying pack portion 190 can be formed of a structural frame including a series of structural members, bars or supports, and can have spaces therebetween. The rear 20, sides 18, and bottom 14 can be formed by a series of spaced apart upper, middle, and lower lateral structural members 188 having portions 188*b* extending laterally or horizontally across the rear 20 and forward projecting ends 188*a* that are redirected or bent to extend along the sides 18; and a series of spaced apart upright or vertical structural members 186 having portions 186*b* rigidly connected to or secured to portions 188*b* of structural members 188 at the rear 20, with forward projecting ends 186*a* that are redirected to extend along the bottom 14. This can form a frame like carrying portion 190 with a top 12 being at the upper edges of the rear 20, and sides 18, and the front 16 being at the forward edges of the sides 18 and bottom 14, with the remainder being open on the top and front to allow desired articles or items to be loaded or unloaded in the interior 190*a* of the carrying portion 190. The articles can be tied, strapped, bungeed or secured in place by suitable means.

The upper structural member 188 can form the stiffening member 66 to which the rear strap redirecting member 60 can be rotatably or pivotably mounted at or near the top 12, and upper portion 104*c* of the support strap 104 can also be secured thereto. The stiffening member 66 can have forward projecting, redirected or bent ends 66*a* to which the side strap redirecting members 50 can be rotatably or pivotably mounted at or near the top 12. The strap segment 24*a* can extend and/or be secured across the bottom 14 and portions 186*a* of structural members 186 and lower portions of the sides 18 and corresponding portions 188*a* of the structural members 188, as well as corresponding bottom and side portions 104*a* and 104*b* of the support strap 104. The portions 186*a* of structural members 186 can form strap segments 24*d* or portions thereof. The carrying portion 190 and structural members 188 and 186 can be made of suitable materials, such as lightweight metals including aluminum and titanium, wood, or composites including carbon fiber and fiberglass. The support strap 104 can be made of similar materials, or flexible materials including those previously described. The operation of the strap arrangement 122 including support strap 104 can be similar to that previously described, and can be similar to that in carrying apparatus 170, backpack 100, and carrying pack 150.

Figure 29:
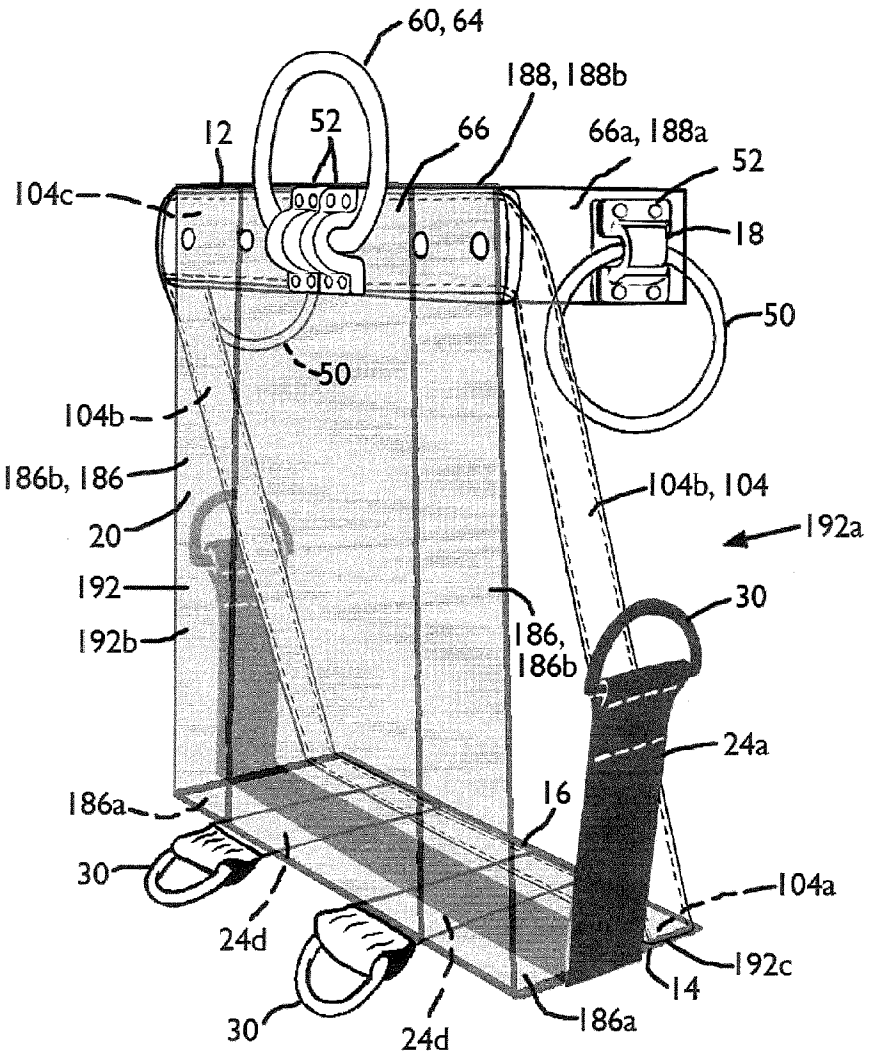
FIG. 29 is a perspective schematic view of an embodiment of a carrying pack or pack portion in the present invention.

Referring to FIG. 29, carrying pack portion 192 can be substituted for carrying portion 190, for use as a front pack or backpack. Carrying portion 192 differs from carrying portion 190 in that the rear 20 and the bottom 14 can include rear 192*b* and bottom 192*c* generally planar or flat structural walls, panels or members. Structural members 186 with the portions 186*b* and 186*a* can be at the outside edges of respective members 192*b* and 192*c* for added strength. Strap segments 24*d* can be secured to and/or extend along the bottom 14 and can be adjacent to portions 186*a*. The lower and middle lateral structural members 188 can be omitted. The upper structural member 188 can form the stiffening member 66 and ends 66*a* to which the respective strap redirecting members 60 and 50 can be rotatably or pivotably secured. Support strap 104 can have bottom, side and upper portions 104*a*, 104*b* and 104*c* extending across and/or secured to corresponding bottom 14, sides 18, and rear 20 at or near the top 12. Carrying portion 192 can be made of similar materials as carrying portion 190, for carrying similar articles in the interior 192*a* and operating with strap arrangement 122 and support strap 104 in a similar manner. In some embodiments the rear 192*b* and bottom 192*a* members can be solid as shown, or can have apertures, or can be formed of mesh or expanded metal.

Figure 30:
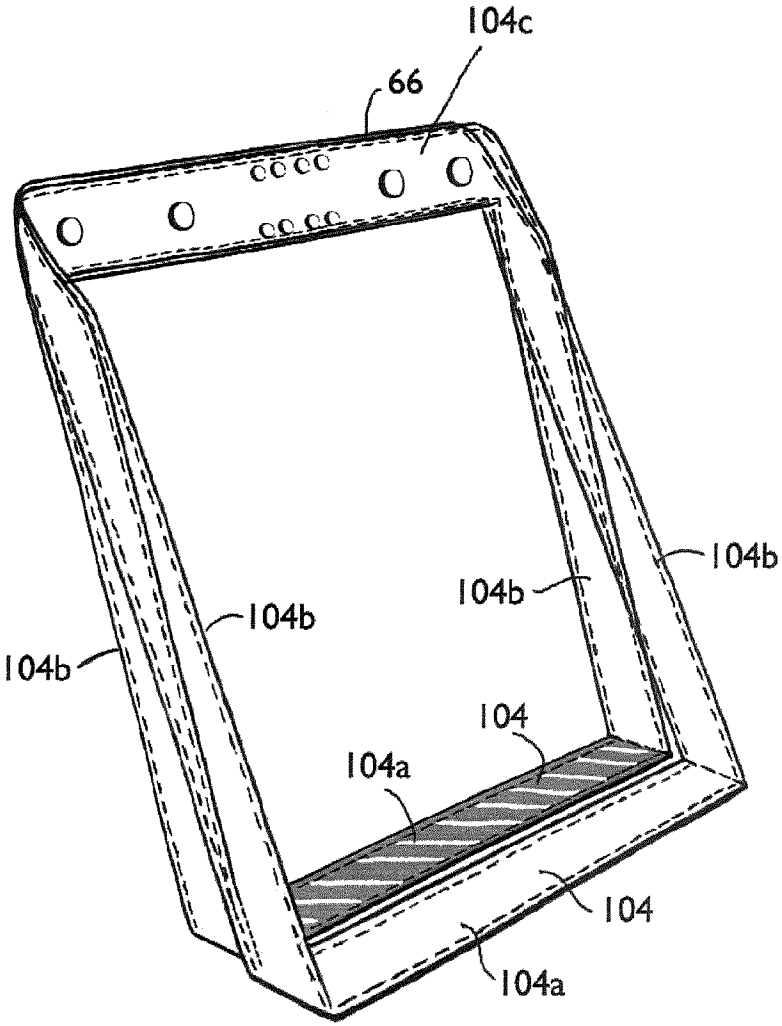
FIG. 30 is a perspective view of an embodiment of a support member or strap in the present invention.

Referring to FIG. 30, two support members or straps 104 can be combined together for use in embodiments of the present invention, for increased support in strength and over a wider area across the bottom 14. The upper portions 104*c* of both support straps 104 can be overlapped and secured to stiffening member 66 with the side portions 104*b* extending downwardly, gradually separating from each other until reaching the bottom 14 where the side portions 104*b* of one support strap 104 are positioned forward of the side portions 104*b* of the other support strap 104. As a result, the bottom portions 104*a* of the two support straps 104 extend across the bottom 14 in side-by-side or adjacent relationship, thereby covering a wide area of the bottom 14 and providing increased support than by a single support strap 104. One bottom portion 104*a* can extend across bottom 14 at or near the front 16, and the other bottom portion 104*a* can be rearwardly adjacent thereto. The twin support straps 104 can transmit a share of the load L with the support tensions S in a similar manner as a described above. In some embodiments, the rearwardly bottom portion 104*a* can overlap with the strap segment 24*a* and can share some of the load with strap segment 24*a*. In some embodiments, a single support strap 104 can be used, but with wider bottom 104*a* and the side 104*b* portions to form a similar structure.

In any of the embodiments shown or described, the strap segments 24*a* and 24*d* can be secured to the bottom 14 at or near the center of the bottom to the facilitate energy harvesting with piezoelectric material 80 positioned in desired locations of the strap arrangement on carrying pack or portion. If needed, guides can be employed to maintain the proper position of the necessary straps. In addition, the strap redirecting members 50 and 60 and/or their respective rotatable axes X and $X_1$, can be positioned generally along a common or the same horizontal plane, level or axis H, as previously described. Furthermore, previously described backpacks having a pack portion can be considered to be a carrying pack or apparatus having a carrying pack portion or carrying portion.

While this invention has been particularly shown and described with references to example embodiments thereof, it will be understood by those skilled in the art that various changes in form and details may be made therein without departing from the scope of the invention encompassed by the appended claims. For example, although the straps 24 are shown extending from the sides 18 from or near the bottom 14, the straps 24 can be extended from positions higher up on the sides 18, depending upon the construction and materials of the pack portion 11. In addition, although the straps 24 have been described as being redirected between about vertical and horizontal positions, and redirected at about right angles, it is understood that these terms are approximations or generalizations since the straps 24 and the redirecting members 50 and 60 can move around a certain amount and can include near vertical and horizontal positions, and near right angles. In some embodiments "near" can include being off by a certain amount. The novel strap arrangements in the present invention can also be secured to other suitable pack portions, and can be sold as a kit. As previously mentioned, strap redirecting members 50 and 60 can include rollers for reducing friction, where sliding of straps 24 relative to members 50 and 60 can occur with a rolling action. Also, various features of the embodiments can be omitted or combined together.

What is claimed is:

1. A carrying apparatus comprising:

a carrying portion having a top, a bottom, a front, a rear, and two sides; and a strap arrangement for enabling carrying of the carrying portion on a body of a user, the strap arrangement comprising a pair of carrying straps, each carrying strap secured to the carrying portion to at least one of the bottom and sides, and extending upwardly along respective sides of the carrying portion, and further comprising strap redirecting members secured to the carrying portion at upper regions of the carrying portion on the two sides and at the rear, redirecting each carrying strap while allowing the carrying straps to move through the redirecting members and being redirected at upper regions of said respective sides to extend around to the rear of the carrying portion, and being redirected at upper regions of the rear to extend downwardly for securement at lower regions of the carrying portion at the rear, the strap arrangement redirecting forces for supporting a load in the carrying portion from the sides of the carrying portion.

2. The carrying apparatus of claim 1 in which the pair of carrying straps extend from a strap extending along the bottom of the carrying portion and extend to lower regions of each side of the carrying portion to support the load from the bottom.

3. The carrying apparatus of claim 1 further comprising:

a side ring secured to upper regions of each side of the carrying portion through which a respective carrying strap passes and is slidably redirected; and at least one rear ring secured to upper regions of the rear of the carrying portion through which the carrying straps pass and are slidably redirected.

4. The carrying apparatus claim 3 in which the pair of carrying straps pass through the at least one rear ring close to each other on opposite sides of a vertical centerline, and the pair of carrying straps are secured at lower regions of the carrying portion at the rear close to each other on opposite sides of the vertical centerline.

5. The carrying apparatus of claim 3 in which the at least one rear ring is rotatably secured to a stiffening member, the stiffening member for stiffening at least an upper portion of the rear of the carrying portion.

6. The carrying apparatus of claim 5 further comprising a support strap secured to the stiffening member, the support strap comprising a bottom portion extending along the bottom of the carrying portion at the front, two side portions extending from opposite ends of the bottom portion to opposite ends of the stiffening member in an angled manner, and an upper portion extending along and mounting against the stiffening member.

7. The carrying apparatus of claim 1 in which the carrying portion includes rigid rear, side and bottom structural members, the strap redirecting members being secured to selected rigid rear and side structural members.

8. The carrying apparatus of claim 7 in which the carrying portion forms a frame on the bottom, rear and two sides, for carrying desired items.

9. The carrying apparatus of claim 1 in which the carrying portion is a child carrier seat in which the bottom, rear and two sides are formed of rigid and/or semi-rigid material.

10. The carrying apparatus of claim 1 in which the strap arrangement includes piezoelectric material for generating electricity.

11. A strap arrangement for carrying a carrying portion as a carrying apparatus, the carrying portion having a top, a bottom, a front, a rear, and two sides, the strap arrangement comprising:

a pair of carrying straps, each carrying strap for securing to the carrying portion to at least one of the bottom and sides and for extending upwardly along respective sides of the carrying portion, and further comprising strap redirecting members securable to the carrying portion at upper regions of the carrying portion on the two sides and at the rear, for redirecting each carrying strap while allowing the carrying straps to move through the redirecting members for being redirected at upper regions of said respective sides to extend around to the rear of the carrying portion, and being redirected at upper regions of the rear to extend downwardly for securement at lower regions of the carrying portion at the rear, the strap arrangement redirecting forces for supporting a load in the carrying portion from the sides of the carrying portion.

12. The strap arrangement of claim 11 in which piezoelectric material is included for generating electricity.

13. A method of forming a carrying apparatus comprising:

providing a carrying portion having a top, a bottom, a rear and two sides; and securing a strap arrangement to the carrying portion for enabling carrying of the carrying portion on a body of a user, the strap arrangement comprising a pair of carrying straps secured to the carrying portion to at least one of the bottom and sides and extending upwardly along respective sides of the carrying portion, and further comprising strap redirecting members which are secured to the carrying portion at upper regions of the carrying portion on the two sides and at the rear, redirecting each carrying strap while allowing the carrying straps to move through the redirecting members and being redirected at upper regions of the said respective sides to extend around to the rear of the carrying portion, and being redirected at upper regions of the rear for extending downwardly for securement at lower regions of the carrying portion at the rear, the strap arrangement for redirecting forces for supporting a load from the sides of the carrying portion.

14. The method of claim 13 further comprising:

extending the pair of carrying straps from a strap extending along the bottom of the carrying portion and to lower regions of each side of the carrying portion to support the load from the bottom.

15. The method of claim 13 further comprising:

providing a side ring that is secured to upper regions of each side of the carrying portion through which a respective carrying strap passes and is slidably redirected;

providing at least one rear ring that is secured to upper regions of the rear of the carrying portion, through which the carrying straps pass and are slidably redirected; and positioning the pair of carrying straps passing through the at least one rear ring close to each other on opposite sides of a vertical centerline, and the pair of carrying straps are secured at lower regions of the carrying portion at the rear close to each other on opposite sides of the vertical centerline.

16. The method of claim 15 further comprising:

providing stiffening for at least an upper portion of the rear of the carrying portion with a stiffening member, the at least one rear ring being rotatably secured to the stiffening member; and securing a support strap to the stiffening member, the support strap comprising a bottom portion extending along the bottom of the carrying portion at the front, two side portions extending from opposite ends of the bottom portion to opposite ends of the stiffening member in an angled manner, and an upper portion extending along and mounting against the stiffening member.

17. The method of claim 13 further comprising providing the carrying portion with rigid rear, side and bottom structural members and securing the strap redirecting members to selected rigid rear and side structural members.

18. The method of claim 17 further comprising:

providing the carrying portion as a frame on the bottom, rear and two sides, for carrying desired items.

19. The method of claim 13 further comprising providing the carrying portion as a child carrier seat in which the bottom, rear and two sides are formed of rigid and/or semi-rigid material.

20. The method of claim 13 further comprising providing the strap arrangement with piezoelectric material for generating electricity.

* * * * *